US005206120A

United States Patent [19]

Hayashi

[11] Patent Number: 5,206,120

[45] Date of Patent: * Apr. 27, 1993

[54] METHOD FOR FORMING COLOR IMAGES

[75] Inventor: Hiroshi Hayashi, Kanagawa, Japan

[73] Assignee: Fuji Photo Film Co., Ltd., Kanagawa, Japan

[ * ] Notice: The portion of the term of this patent subsequent to Nov. 5, 2008 has been disclaimed.

[21] Appl. No.: 627,105

[22] Filed: Dec. 13, 1990

[30] Foreign Application Priority Data

Dec. 15, 1989 [JP] Japan ..... 1-324045

[51] Int. Cl.[5] ..... G03C 7/32

[52] U.S. Cl. ..... 430/376; 430/377; 430/539; 430/963

[58] Field of Search ..... 430/376, 377, 399, 434, 430/539, 567, 628, 640, 642, 963

[56] References Cited

U.S. PATENT DOCUMENTS 4,830,948 5/1989 Ishikawa et al. ..... 430/642

5,063,139 11/1991 Hayashi ..... 430/642

*Primary Examiner*—Hoa Van Le

*Attorney, Agent, or Firm*—Sughrue, Mion, Zinn, Macpeak & Seas

[57] ABSTRACT

A method for forming a color image comprising the step of: developing a silver halide color photographic material for a color developing time of about 20 seconds or less and for a total processing time from color developing to drying of about 100 seconds or less, wherein the silver halide color photographic material comprises (a) a support; and (b) at least two layers on at least one side of the support, each of said at least two layers containing (i) a silver halide emulsion containing at least 90 mol% silver chloride and at least 50% by weight of gelatin as a binder, the gelatin having an isoelectric point of at least 5.3, and (ii) a diffusion resistant oil-soluble coupler that forms a dye by coupling with an oxidation product of an aromatic primary amine developing agent; and (c) the silver halide in the at least two layers differing in sensitivity wavelength range.

10 Claims, No Drawings

METHOD FOR FORMING COLOR IMAGES

FIELD OF THE INVENTION

The present invention relates to a method for forming color images by developing silver halide color photographic materials, and more particularly to a novel method for forming color images for high quality color prints that are excellent for very rapid processability.

BACKGROUND OF THE INVENTION

In recent years, high efficiency and high productivity have been required more and more to process color photographic materials. This is particularly the case for the production of color prints, for which a reduction in print processing time has been strongly desired with a view towards short finishing times.

Color print finishing comprises exposure and color development processing. The use of highly sensitive photographic materials in color print processing results in a reduction in exposure time. On the other hand, in order to shorten the time of color development, it is necessary to realize systems in which photographic materials capable of speeding development are combined with processing solutions or processing methods. Techniques for solving such problems are known such as the methods of processing color photographic materials containing silver halide emulsions other than silver chlorobromide emulsions which are high in silver bromide content, such techniques are widely used for photographic materials for color prints and are hereinafter referred to as color photographic paper. For example, PCT International Publication No. W088/00723 discloses the method of processing rapidly a color photographic material comprising a silver chloride emulsion with a color developing solution substantially free from a sulfite ion and benzyl alcohol.

In addition to the above patent, JP-A-61-70552 (the term "JP-A" as used therein means an "unexamined published Japanese patent application") discloses a method for reducing the quantity of replenisher of a developing solution, in which the replenisher is added in such an amount that an overflow to a developing bath does not take place during development, using a high silver chloride color photographic material. Further, JP-A-63-106655 discloses the method of processing a high silver chloride color photographic material with a color developer containing a hydroxylamine compound and chlorine ions at a concentration of at least a specific value, for the purpose of stabilizing processing.

By the use of the high silver chloride emulsions or improvements in developing solutions, the time of development is shortened from 3.5 minutes (for example, color processing CP-20, Fuji Photo Film Co., Ltd.) to 45 seconds (for example, color processing CP-40FAS, Fuji Photo Film Co., Ltd., total processing time: 4 minutes). However, compared to the total processing time of other color systems such as electrostatic image transfer systems, thermal transfer systems, and ink jet systems these methods cannot be said to be yet at a sufficient level.

For this reason, development of a silver halide color photographic material for very rapid processing in which the total processing time is considerably reduced so that the material can be developed in about 20 seconds using silver halide color developing systems to thus provide color prints high in image quality at low cost are desired.

On the other hand, the use of techniques other than emulsion techniques for rapid processing have also been studied. In particular, such techniques are ones in which the developing time can be reduced to 180 seconds or less in silver chlorobromide systems; ones that involve the control of the swollen thickness of photographic materials or the applied amount of gelatins by processing solutions; or ones involving novel developing agents. Examples of these are proposed in JP-A-63-38937, JP-A-63-40144, JP-A-63- 146039, JP-A-61-286855, JP-A-61-289350, and JP-A-61-286854.

It has been however impossible to obtain color photographs having sufficiently high image quality using color development of about 20 seconds, based on the above prior-art information.

Further, in color photographic materials for which very rapid processing is possible, it is of course important as merchandise value to shorten the total processing time from the initiation of processing to the termination thereof (production of a print in a dried state). In particular, however, when a washing stage is simplified and speeded up, developing solution components and bleaching-fixing solution components remain in the photographic materials in larger amounts, when compared with the case that washing is carried out for a relatively long time as disclosed in the prior-art.

It is known that residual developing solution components and bleaching-fixing solution components in photographic materials effect the shelf life of prints. Residual color developing agents react with unreacted couplers to produce undesired stains. When the bleaching components remain in the photographic materials, the atmosphere of the photographic materials is changed to an oxidizing one, so that yellow stains are produced particularly under the circumstances of high temperature and humidity. Such stains can be ameliorated by keeping the pH of the photographic materials low. However, lowering the pH exacerbates the fading of cyan and yellow colors under the circumstances of high temperature and humidity.

In JP-A-58-14834, JP-A-61-20864, JP-A-60-263939, JP-A- 61-170742, JP-A-58-132743, and JP-A-61-151538 are described techniques for avoiding the introduction of coloring components in photographic materials or for making them colorless when washing is not sufficient. In all cases, however, the washing time and the washing amount are extremely decreased in very rapid processing. As a result, developing solution components and bleaching-fixing solution components are introduced to the photographic materials in larger amounts than those in the prior-art washing, which results in an insufficient effect. In particular, in continuous processing, coloring components from bleaching-fixing baths are introduced to the photographic materials in larger amounts, and the coloring components remain therein. Consequently, when the resulting prints are stored under the circumstances of high temperature and humidity, stains are generated on the white portions or the image portions are faded thus lowering the merchandise value thereof.

SUMMARY OF THE INVENTION

These and other objects of the invention can be realized by a method for forming a color image comprising the step of:

developing a silver halide color photographic material for a color developing time of about 20 seconds or less and for a total processing time from color developing to drying of about 100 seconds or less, wherein the silver halide color photographic material comprises (a) a support; and (b) at least two layers on at least one side of said support, each of the at least two layers containing (i) a silver halide emulsion containing at least 90 mol% silver chloride and at least 50% by weight of gelatin as a binder, the gelatin having an isoelectric point of at least 5.3, and (ii) a diffusion resistant oil-soluble coupler that forms a dye by coupling with an oxidation product of an aromatic primary amine developing agent, and (c) the silver halide in the at least two layers differing in sensitivity wavelength range each other.

It was further revealed that the following methods were particularly advantageous for very rapid processing and prevention of stains under at high temperatures and at high humidity:

(1) The method for forming a color image as stated above, wherein the total amount of the gelatin is 2.0 to 6.0

(2) The method for forming a color image as stated above, further comprising the step of:

washing the silver halide color photographic material (i) at a temperature of at least 35° C., (ii) using a countercurrent system of 2 to 5 washing baths, where the total time in each washing bath is about 45 seconds.

(3) The method for forming a color image as stated above, wherein the quantity of replenisher used in the washing step is less than 150 ml/m$^2$ of color photographic material.

(4) The method for forming a color image as stated above wherein each washing bath contains one of the following: an organic phosphonic acid, an organic phosphonate, or a combination thereof.

(5) The method, as stated above, for forming a color image where the organic phosphonic acid, the organic phosphate, or both the organic phosphonic acid and the organic phosphate is one of the following, an alkylidenediphosphonic acid, a salt of an alkylidenediphosphonic acid, or a combination thereof.

DETAILED DESCRIPTION OF THE INVENTION

In the present invention, the total processing time (including the drying stage) is 100 seconds or less, preferably 20 to 100 seconds. Hence, the processing time of the bleaching-fixing stage, a stage next to color development, is required to be about 10 to 45 seconds. For the succeeding washing stage, the same is expected. It has been previously known that, when this washing stage is drastically accelerated the residual color developing agent, bleaching agent, or fixing agent causes a significant deteriorate in the shelf life of the prints.

The removal of these residual agents from photographic materials was reported by Haruhiko Iwano, Takatoshi Ishikawa, Genichi Furusawa, et al. at the 5th International Symposium of Photofinishing Technology (Chicago, 1988), under the title of "The Chemistry of Washing: The Way to Ensure Photoprocessing Quality at Minilabs". According to this report, the removal of the developing agents is directly related to the washing time, the washing temperature, and the stirring speed, and the removal of ethylenediaminetetraacetic acid Fe (III) frequently used as the fixing agent is directly related to the amount of rinsing water and the multistage countercurrent system. It is believed in the art that the difference between the means to promote the removal of the developing agents and the means to promote the removal of the fixing agent depends on the degree of interaction with the binder.

In particular, in very rapid processing, it has been found that the shelf life (generation of stains) of continuously processed prints deteriorate excessively due to the reduction in washing time that results when processing is speeded up.

Further, in the case of very rapid processing and washing processing at a low replenishment rate, both of which are part of the present invention, it is difficult to sufficiently remove the developing agent, the bleaching agent, and the fixing agent because of the short washing time. Under such conditions, the bleaching agent [ethylenediaminetetraacetic acid Fe (III) (hereinafter referred to as EDTA-Fe(III) is usually used] accumulate because the low replenishment rate of 150 ml/m$^2$ or less contaminates a washing tank, whereby the shelf life (generation of stains) of the prints deteriorates (i.e. stains are generated). Namely, this EDTA-Fe(III) is distributed in a film layer at the same concentration as it exists in the rinsing water, and remains in the photographic material even after washing and drying to produce stains under the conditions of high temperature and humidity, as described above.

EDTA-Fe(III) is used in an amount as large as about 60 g (about 140 mmols) per either of bleaching-fixing agent, as described in examples of JP-B-61-57623 (the term "JP-B" as used herein means an "examined Japanese patent publication"). From a bleaching-fixing bath, the bleaching-fixing agent is usually introduced in a washing bath in an amount of 30 to 70 ml per m$^2$ of photographic material. When continuous processing is carried out, therefore, contamination with a large amount of the bleaching-fixing agent is induced.

As described above, the amount of rinsing water and the washing system such as a multistage countercurrent system can be effective to remove EDTA-Fe(III). Considering the current tends toward speeding up processing and reducing the size of development-processing equipment, however, a satisfactory amount of rinsing water and a properly configured washing system cannot be realized. However, the developing agent another major factor in generating stains, can be used in relatively small amounts such that it begins to be removed in the bleaching-fixing bath of the succeeding stage. Further, the removing rate of the developing agent can be acculerated by adjusting the temperature and the stirring speed. From these points, the developing agent is an advantageous factor in the system of the present invention. In order to ensure quality processing using washing at a low replenishment rate with very rapid processing, the use of a large amount of rinsing water and large-sized equipment is required, which as noted above, is not compatible with current system designs.

The studies by the present inventors have revealed that stains produced in the continuous processing are induced by the interaction of EDTA-Fe(III) with gelatins, the binder, and further promoted by other components in the photographic material. According to the present invention, the causes of the stains are eliminated by using gelatins that have little interaction with EDTA-Fe(III) as the binder. This permits efficient, low cost's high quality prints suitable for very rapid processing.

In the present invention, the stains are decreased by using gelatins having a high isoelectric point.

The concept of the isoelectric point is well known. A measuring method for the isoelectric point is described in A. Steigmann, *Sci. Ind. Photogr.* (2) 35, 145 (1964). *Test Methods of Photographic Gelatin* (*PAG Method*), 5th edition (Joint Council of Test Methods of Photographic Gelatin, published on October, 1982) describe a method for determining the isoelectric point by passing a 1% gelatin solution through a mixed bed column of cation and anion exchange resins, and then measuring the pH of the resulting solution.

Color photographic material according to the present invention can be formed by applying at least one layer each for a blue-sensitive, a green-sensitive, and a red-sensitive silver halide emulsion layers on a support. For ordinary photographic printing paper, the silver halide emulsion layers are usually applied on the support in the above-described order, but they may be applied in a different order. Further, an infrared-sensitive silver halide emulsion layer can be used in place of at least one of the above-described emulsion layers. Each of these sensitive emulsion layers contains a silver halide emulsion having sensitivity to each wavelength region and a dye complementary to light to which the emulsion layer is sensitive. That is, a color coupler forming yellow to blue, magenta to green, or cyan to red, thus permitting color reproduction to be achieved according to a subtractive color process. However, the sensitive emulsion layers and the formed colors may be combined so as not to have the correspondence described above it desired.

As silver halide emulsions used in the present invention, emulsions comprising silver chlorobromide or silver chloride substantially free from silver iodide are preferably used. Here, "substantially free from silver iodide" means that the content of silver iodide is 1 mol% or less and preferably 0.2 mol% or less. Grains contained in the emulsion may be the same or different from one another in halogen composition. However, when an emulsion contains grains that each have the same halogen composition, it is easy to homogenize the properties of each grain.

With respect to the internal halogen composition distribution of the silver halide grains, grains of a uniform type structure in which the composition is the same at any portion of the grain; grains of a laminated type structure in which an internal core of the grain is different from a shell (one layer or a plurality of layers) surrounding it in halogen composition; or grains of a structure in which the inside of the grain or the surface thereof has non-layer portions different in halogen composition (a structure in which the portions different in halogen composition are connected to the edges, the corners or the surface of the grain when they are on the surface of the grain) can be used.

A method for forming the localized phase comprises either by a halogen conversion using water soluble bromide compound or by mixing with small size silver bromide grains taught in EP 0273430.

In order to obtain high sensitivity, it is more advantageous to use either of the latter two grains than to use grains of the uniform type structure. The latter two grains are preferable also in respect to pressure resistance. When silver halide grains have the structures described above, a boundary between portions different from each other in halogen composition may be clear or unclear due to formation of mixed crystals that result from differences in composition. Further, continuous changes in structure may be positively given thereto.

The silver chloride content of the high silver chloride emulsions of the present invention is preferably at least 90 mol%, more preferably 95 mol% and the most preferably 98 mol%.

In such high silver chloride emulsions, the grains of a structure in which the inside and/or surface of the silver halide grain has silver bromide-localized layers in a layer form or in a non-layer form are preferred. The halogen composition of the above-described localized layers is preferably at least 10 mol% and more preferably above 20 mol% in silver bromide content. These localized layers can exist inside the grain and on the edges, the corners and the surface of the grain. As one preferred example, there can be mentioned localized layers formed on the corner portions of the grain by epitaxial growth.

On the other hand, for the purpose of minimizing a reduction in sensitivity when pressure is applied to the photographic materials, the grains of the uniform type structure in which the halogen composition distribution in the grain is small are also preferably used.

Further, for the purpose of reducing the quantity of replenisher of a developing solution, it is also effective to increase the silver chloride content of the silver halide emulsions. In such a case, emulsions containing 98 to 100 mol% of the silver chloride are preferably used.

It is preferred that the silver halide grains contained in the silver halide emulsions used in the present invention have a mean grain size of 0.1 to 2 m. The mean grain size is a mean numerical value of grain sizes represented by the diameters of circles equivalent to the projected areas of the grains.

Further, it is preferred that these emulsions are so-called monodisperse emulsions having a narrow grain size distribution, namely a coefficient of variation (the standard deviation of the grain size distribution divided by the mean grain size) of not more than 20%, desirably not more than 15%. At this time, for the purpose of obtaining a wide latitude, it is preferred that the above-described monodisperse emulsions be blended in the same layer, or be coated in multiple layers.

The silver halide grains contained in the photographic emulsions may have a regular crystal form such as a cubic, octahedral, or a tetradecahedral form; an irregular crystal form such as a spherical form or a plate (tabular) form; or a composite form thereof. Further, a mixture of grains having various crystal forms may also be used. In the present invention, it is desirable that the emulsions contain at least 50% (by number of grains), preferably at least 70% and more preferably at least 90% of the above-described grains having a regular crystal form.

Other than these, there can be preferably used an emulsion in which more than 50% (by number of grains) of all grains as a projected area are composed of plate-form grains having a mean aspect ratio (a ratio of diameter (calculated as circle)/thickness) of at least 5 and preferably at least 8.

The silver chlorobromide emulsions used in the present invention can be prepared according to the methods described in P. Glafkides, *Chimie et Phisique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). Namely, any emulsions produced by an acid process, a neutral process, or an ammonia process may be used. A soluble silver salt and a soluble halogen salt may be reacted with each other by using a single jet process, a double jet process, or a combination thereof. A so-called reverse mixing process in which grains are formed in the presence of excess silver ions can also be used. As a type of double jet process, there can also be used the process for maintaining the pAg in the liquid phase in which a silver halide is formed constant, namely, a so-called controlled double jet process. According to this process, a silver halide emulsion having a regular crystal form and an approximately uniform grain size can be obtained.

In the course of formation of grain emulsions or physical ripening, various multivalent metal ion impurities can be introduced in the silver halide emulsions used in the present invention. Examples of the compounds used include salts of cadmium, zinc, lead, copper and thallium; salts of the Group VIII metals of the Periodic Table, such as iron, ruthenium, rhodium, palladium, osmium, iridium and platinum; and complex salts thereof. In particular, the salts of the Group VIII metals of the Periodic Table and the complex salts thereof are preferably used. Although the addition amount of these compounds varies over a wide range depending on the object, it is preferred that the compounds be added in an amount of $10^{-9}$ to $10^{-2}$ mol per mol of silver halide.

The silver halide emulsions used in the present invention are generally subjected to chemical sensitization and spectral sensitization.

With respect to chemical sensitization, sulfur sensitization represented by the addition of unstable sulfur compounds; noble metal sensitization represented by gold sensitization; and reduction sensitization can be used individually or in combination. The compounds described on page 18, lower right column to page 22, upper right column of JP-A-62-215272 are preferably used for chemical sensitization.

Spectral sensitization is carried out for the purpose of giving spectral sensitivity in a desired light wavelength range to a emulsion of each layer of the photographic material according to the present invention. In the present invention, it is preferred that spectral sensitization be carried out by adding a dye which absorbs light in a wavelength range corresponding to a desired spectral sensitivity, namely a spectrally sensitizing dye. The spectrally sensitizing dyes used in this case include dyes described in F. M. Harmer, *Heterocyclic Compounds-Cyanine Dyes and Related Compounds* (John Wiley & Sons, New York and London, 1964). Specific examples of the compounds and spectrally sensitizing methods which are preferably used are described on page 22, upper right column to page 38 of JP-A-62-215272.

In order to prevent fogging during manufacturing, storage or photographic processing of the photographic materials used or to stabilize photographic properties thereof, various compounds or their precursors may be added to the silver halide emulsions used in the present invention. Specific examples of these compounds which are preferably used are described on page 39 to page 72 of JP-A-62-215272 described above.

The emulsions used in the present invention may be either the so-called surface latent image emulsions in which latent images are mainly formed on the surface of grains or the so-called internal latent image emulsions in which the latent images are mainly formed in the interior of the grains.

The color photographic materials according to the present invention usually contain diffusion resistance yellow couplers, magenta couplers, and cyan couplers which are coupled with oxidation products of aromatic amine color developing agents to form a yellow color, a magenta color, and a cyan color, respectively. The terms of a "diffusion resistance coupler" used in the present invention means the coupler having so-called ballast group in a molecule.

Cyan couplers, magenta couplers and yellow couplers which are diffusion resistance and preferably used in the present invention are represented by the following general formulae (C-I), (C-II), (M-I), (M-II) and (Y).

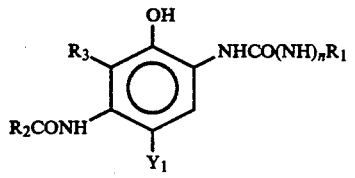

(C-I)

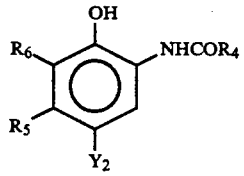

(C-II)

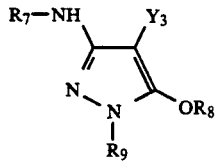

(M-I)

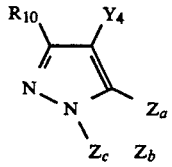

(M-II)

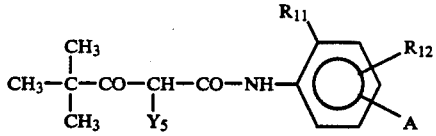

(Y)

In general formulae (C-I) and (C-II), each of $R_1$, $R_2$, and $R_4$ represents a substituted or unsubstituted aliphatic, aromatic, or heterocyclic group; each of $R_3$, $R_5$ and $R_6$ represents a hydrogen atom, a halogen atom, an aliphatic group, an aromatic group, or an acylamino group; $R_3$ may represent a nonmetallic atom which combines together with $R_2$ to form a nitrogen-containing 5-membered or 6-membered ring; each of $Y_1$ and $Y_2$ represents a hydrogen atom or a group which is eliminated by coupling reaction with an oxidation product of a developing agent; and n represents 0 or 1. At least one of $R_1$, $R_2$, $R_3$ and $Y_1$ preferably represent groups having 10 or more of carbon atom in total, and at least one of $R_4$, $R_5$, $R_6$ and $Y_2$ preferably represent groups having 10 or more of carbon atoms in total.

$R_5$ in general formula (C-II) is preferably an aliphatic group. Examples of such aliphatic groups include methyl, ethyl, propyl, butyl, pentadecyl, tert-butyl, cyclohexyl, cyclohexylmethyl, phenylthiomethyl, dodecyloxyphenylthiomethyl, butaneamidomethyl, and methoxymethyl.

Preferred examples of the cyan couplers represented by the above-described general formulae (C-I) and (C-II) are as follows.

In general formula (C-I), $R_1$ is preferably an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When $R_3$ and $R_2$ do not form a ring in general formula (C-I), $R_2$ is preferably a substituted or unsubstituted alkyl or aryl group, and, more preferably, is an alkyl group substituted by a substituted aryloxy group. $R_3$ is preferably a hydrogen atom.

In general formula (C-II), $R_4$ is preferably a substituted or unsubstituted alkyl or aryl group, and, more preferably an alkyl group substituted by a substituted aryloxy group.

In general formula (C-II), $R_5$ is preferably an alkyl group having 2 to 15 carbon atoms or a methyl group having a substituent group of at least one carbon atom. As the substituent group, there is preferably used an arylthio group, an alkylthio group, an acylamino group, an aryloxy group, or an alkyloxy group.

In general formula (C-II), $R_5$ is more preferably an alkyl group having 2 to 5; most preferably having 2 to 4 carbon atoms.

In general formula (C-II), $R_6$ is preferably a hydrogen atom or a halogen atom, and more preferably a chlorine atom or a fluorine atom.

In general formulae (C-I) and (C-II), each of $Y_1$ and $Y_2$ is preferably a hydrogen atom, a halogen atom, an alkoxy group, an aryloxy group, an acyloxy group, or a sulfonamido group.

In general formula (M-I), each of $R_7$ and $R_9$ represents an aryl group; $R_8$ represents a hydrogen atom, an aliphatic or aromatic acyl group, or an aliphatic or aromatic sulfonyl group; and $Y_3$ represents a hydrogen atom or group that can be eliminated. At least one of $R_7$, $R_8$, $R_9$ and $Y_3$ preferably represent groups having 10 or more of carbon atoms in total.

Substituent groups permissible for aryl groups (preferably phenyl groups) of $R_7$ and $R_9$ are the same as substituent groups permissible for the substituent group $R_1$ of general formula (C-I). If there are two or more substituent groups, they may be the same or different. $R_8$ is preferably a hydrogen atom, an aliphatic acyl group or an aliphatic sulfonyl group, and more preferably a hydrogen atom. $Y_3$ is preferably a group which can be eliminated at a sulfur atom, an oxygen atom, or a nitrogen atom. For example, groups that can be eliminated at a sulfur atom as described in U.S. Pat. No. 4,351,897 and PCT International Publication No. W088/04795 are particularly preferable.

In general formula (M-II), $R_{10}$ represents a hydrogen atom or a substituent group. $Y_4$ represents a hydrogen atom or a cleaving group, and preferably a halogen atom or an arylthio group. Each of Za, Zb and Zc represents methine, substituted methine, =N—or —NH—. One of the Za—Zb bond and the Zb—Zc bond is a double bond and the other is a single bond. When the Zb—Zc bond is a carbon-carbon double bond, it may constitute a part of an aromatic ring. The couplers of general formula (M-II) include a dimer or a multimer formed by $R_{10}$ or $Y_4$ and, when Za, Zb, or Zc represent a substituted methine, a dimer or a multimer formed by the substituted methine. When $R_{10}$, $Y_4$ or Za, Zb, Zc represent substituted methine, at least on of the substituents preferably represent groups having 10 or more of carbon atoms in total.

Of the pyrazolotriazole couplers represented by general formula (M-II), the imidazo[1,2-b]pyrazoles described in U.S. Pat. No. 4,500,630 are preferable in respect to the decreased yellow side adsorption and the light fastness of color forming dyes. In particular, pyrazolo[1,5-b][1,2,4]triazole described in U.S. Pat. No. 4,540,654 is preferable.

In addition, there are preferably used a pyrazolotriazole coupler having a branched alkyl group directly connected to the 2-, 3-, or 6-position of a pyrazolotriazole ring as described in JP-A-61-65245, a pyrazoloazole coupler containing a sulfonamido group in its molecule as described in JP-A-61-65246, a pyrazoloazole coupler having an alkoxyphenylsulfonamido ballast group as described in JP-A-61-147254, and a pyrazolotriazole coupler having an alkoxy group or an aryloxy group at the 6-position of a pyrazolotriazole ring as described in European Patents 226,849 and 294,785.

In general formula (Y), $R_{11}$ represents a halogen atom, an alkoxy group, a trifluoromethyl group, or an aryl group; and $R_{12}$ represents a hydrogen atom, a halogen atom, or an alkoxy group. A represents —NH-$COR_{13}$, —$NHSO_2$—$R_{13}$, —$SO_2NHR_{13}$, —$COOR_{13}$, and $$-SO_2\underset{\underset{R_{14}}{|}}{N}-R_{13};$$

provided each of $R_{13}$ and $R_{14}$ represents an alkyl group, an aryl group, or an acyl group. $Y_5$ represents a group that can be eliminated. Substituent groups of $R_{12}$, $R_{13}$, and $R_{14}$ are the same as the substituent groups permissible for $R_1$ of general formula (C-I). The eliminable group $Y_5$ is preferably a group which is eliminable at an oxygen atom or a nitrogen atom. In particular, groups of the nitrogen eliminable type are preferable. At least one of $R_{11}$, $R_{12}$, A and $Y_5$ preferably represent groups having 10 or more of carbon atoms in total.

Specific examples of the couplers represented by general formulae (C-I), (C-II), (M-I), (M-II), and (Y) are enumerated below.

(C-1)
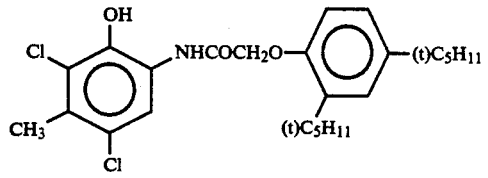
(C-2)
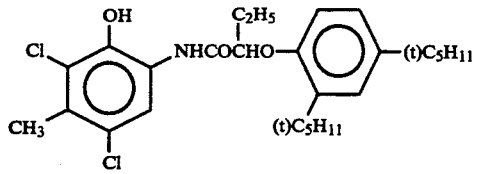
(C-3)
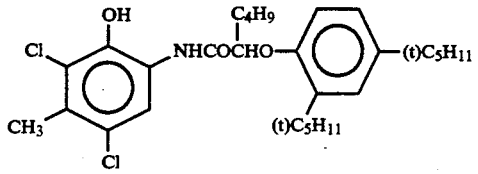
(C-4)
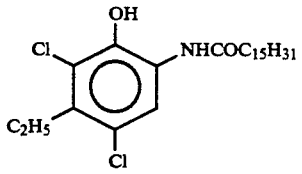
(C-5)
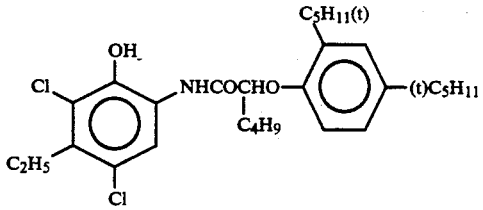
(C-6)
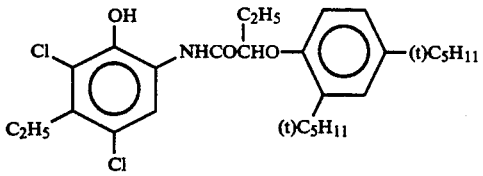
(C-7)
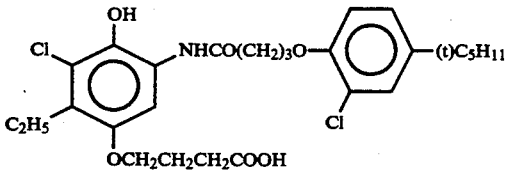
(C-8)
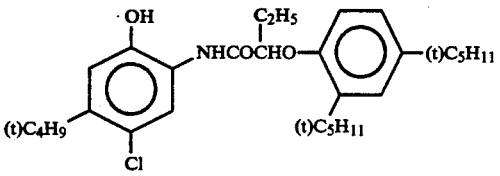

-continued
(C-9)
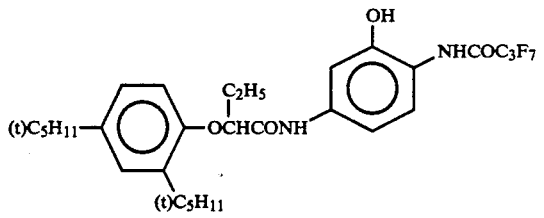
(C-10)
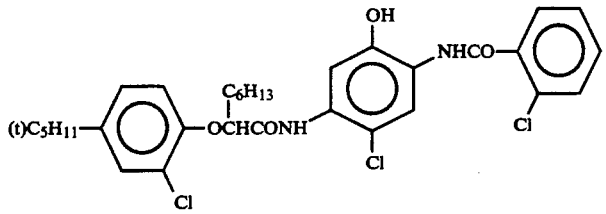
(C-11)
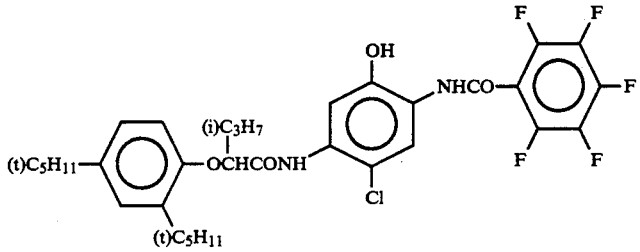
(C-12)
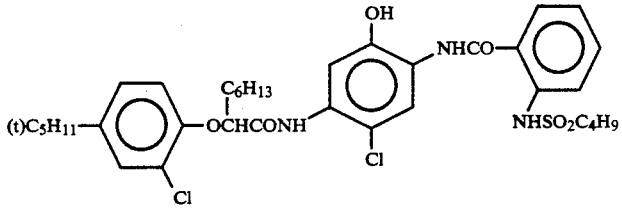
(C-13)
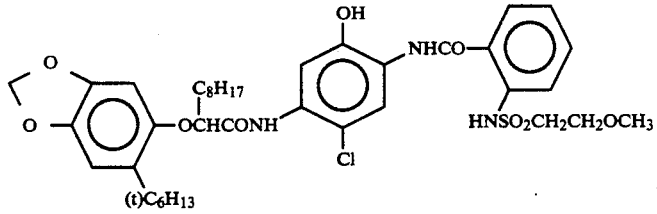
(C-14)
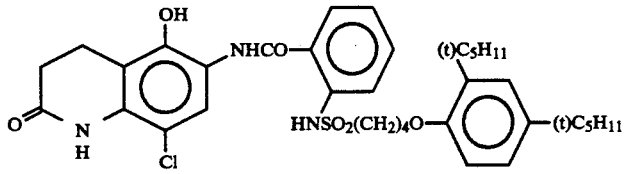
(C-15)
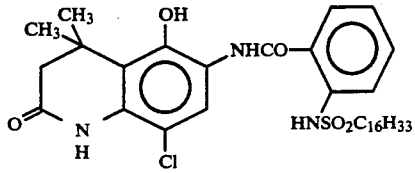

-continued
(C-16)
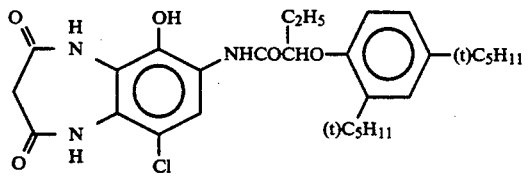
(C-17)
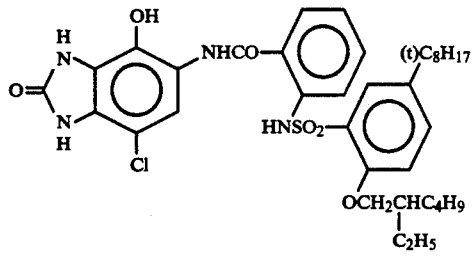
(C-18)
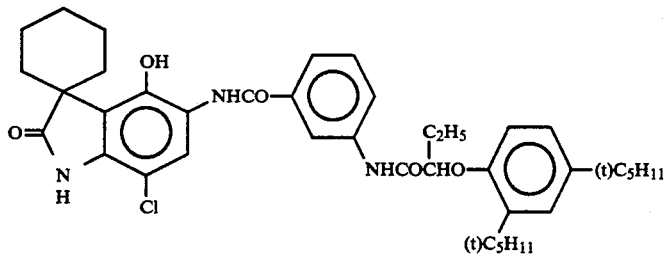
(C-19)
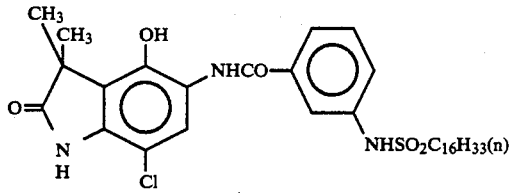
(C-20)
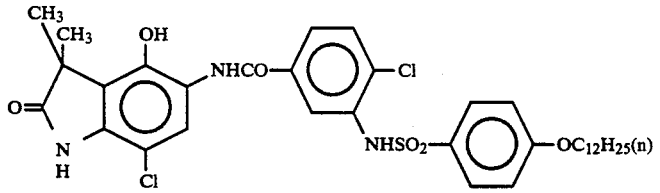
(C-21)
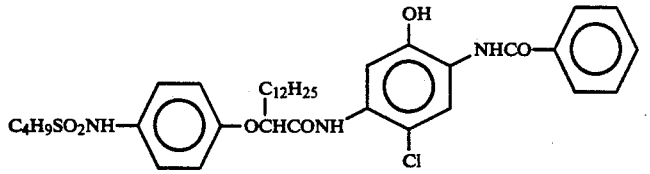
(C-22)
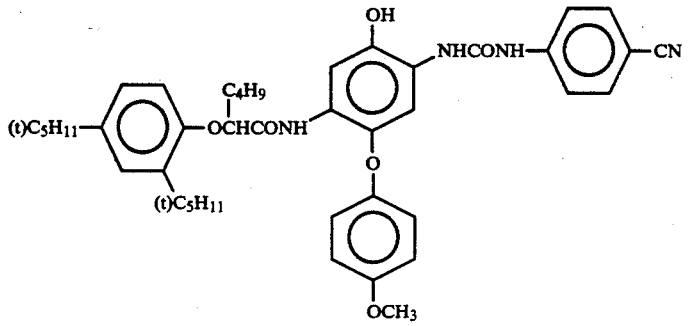

-continued
(M-1)
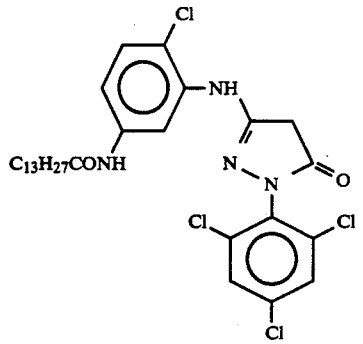
(M-2)
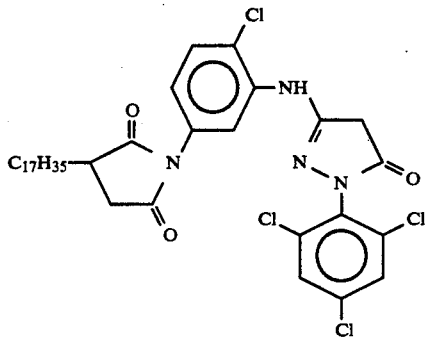
(M-3)
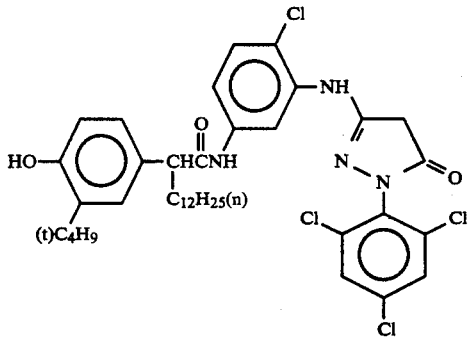
(M-4)
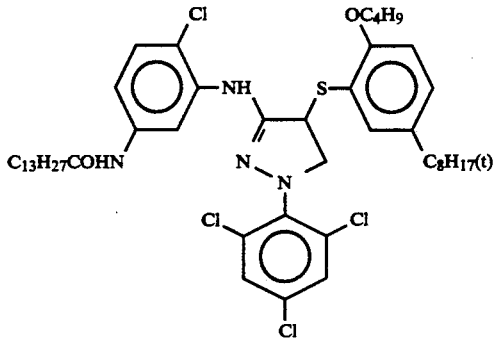

-continued
(M-5)
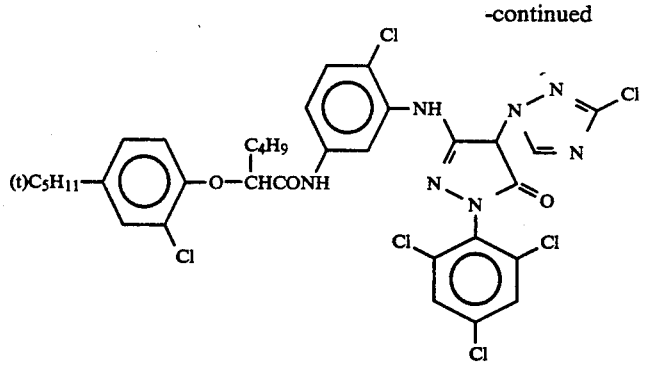
(M-6)
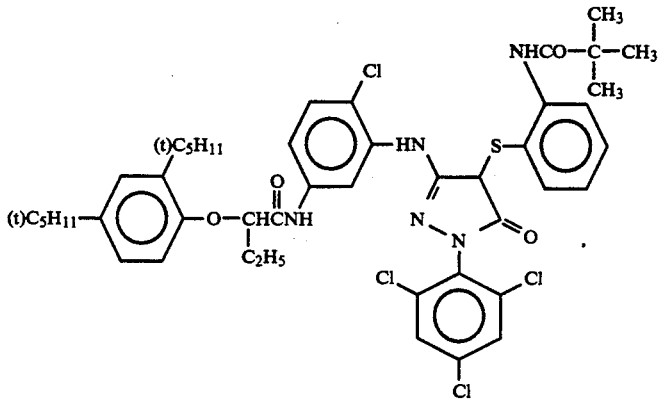
(M-7)
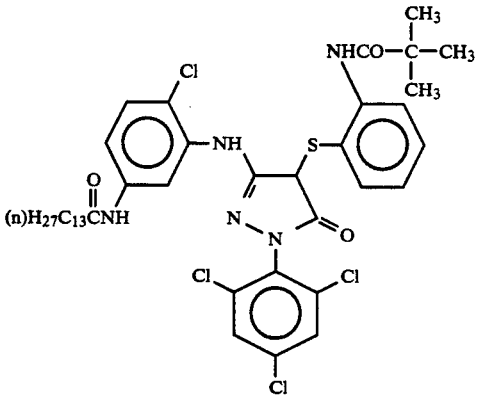
(M-8)
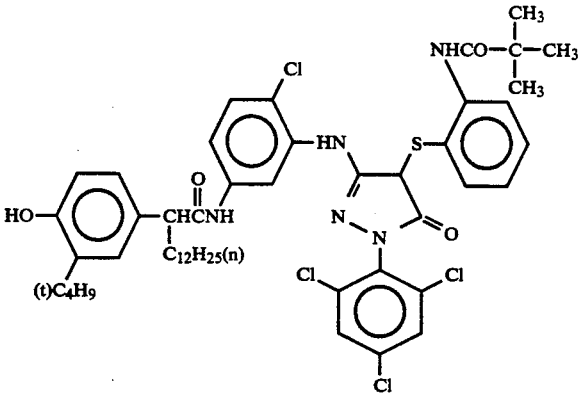

| Compound | $R_{10}$ | $R_{15}$ | $Y_4$ |
|---|---|---|---|
| | | 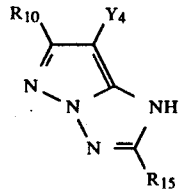 | |
| M-9 | $CH_3$— | 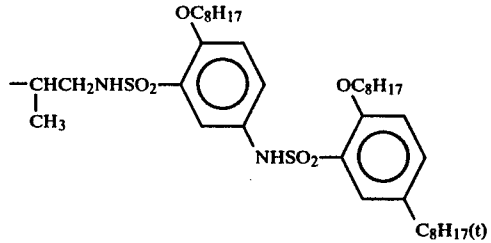 | Cl |
| M-10 | " | 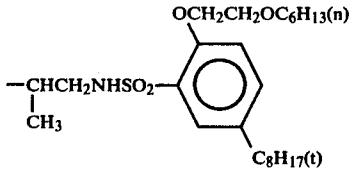 | " |
| M-11 | $(CH_3)_3C$— | 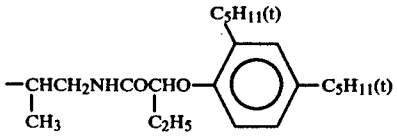 | 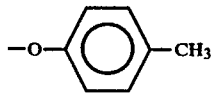 |
| M-12 | 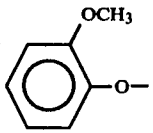 | 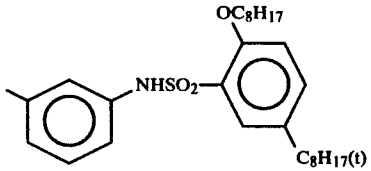 | 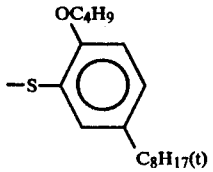 |

-continued
| Compound | $R_{10}$ | $R_{15}$ | $Y_4$ |
|---|---|---|---|
| M-13 | $CH_3$— | 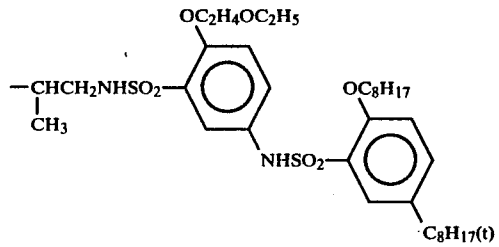 | Cl |
| M-14 | " | 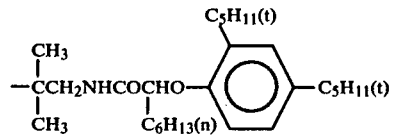 | " |
| M-15 | " | 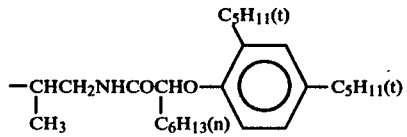 | " |
| M-16 | $CH_3$— | 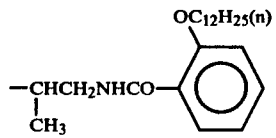 | Cl |
| M-17 | " | 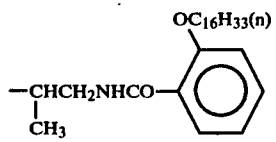 | " |

-continued
| Compound | $R_{10}$ | $R_{15}$ | $Y_4$ |
|---|---|---|---|
| M-18 | 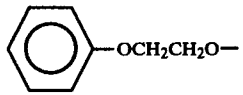 | 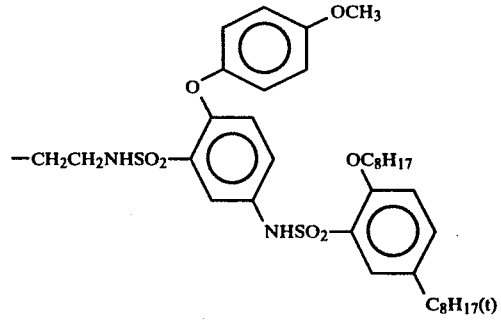 | 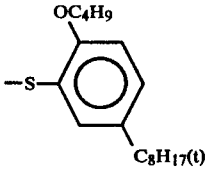 |
| M-19 | $CH_3CH_2O-$ | " | " |
| M-20 | 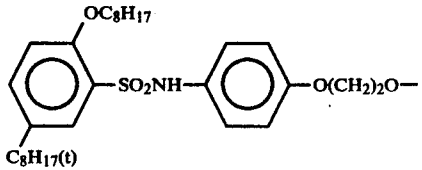 | 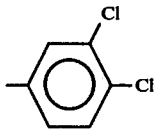 | 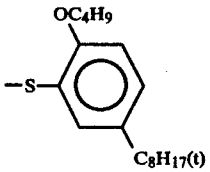 |
| M-21 | 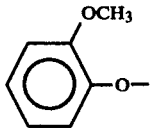 | 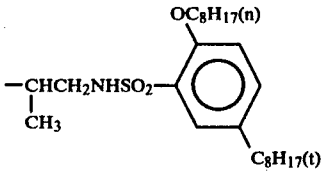 | Cl |
| | 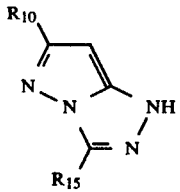 | | |
| M-22 | $CH_3-$ | 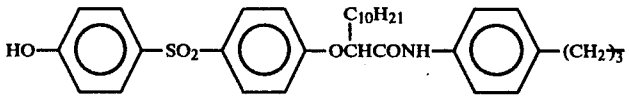 | Cl |

-continued
| Compound | $R_{10}$ | $R_{15}$ | $Y_4$ |
|---|---|---|---|
| M-23 | " | 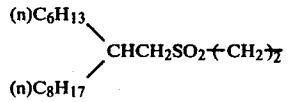 | " |
| M-24 | 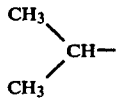 | 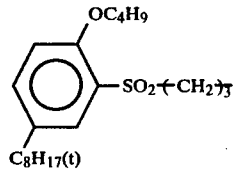 | " |
| M-25 | 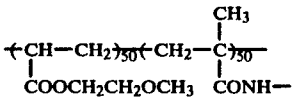 | 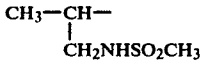 | " |
| M-26 | 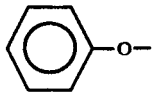 | 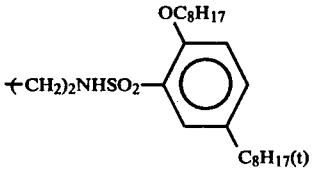 | Cl |
| M-27 | $CH_3$— | 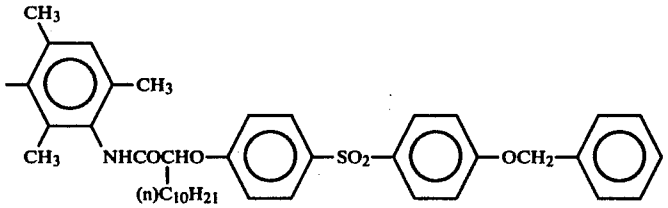 | " |
| M-28 | $(CH_3)_3C$— | 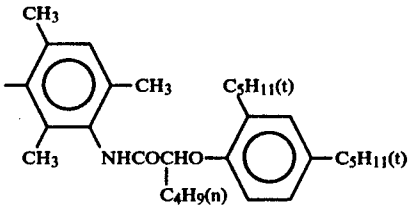 | " |

-continued
| Compound | $R_{10}$ | $R_{15}$ | $Y_4$ |
|---|---|---|---|
| M-29 | 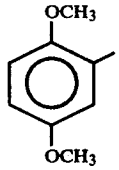 | 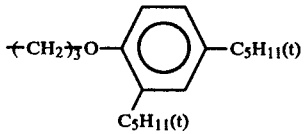 | " |
| M-30 | $CH_3$— | $(n)C_{18}H_{37}$<br>—CH—NCOCH$_2$CH$_2$COOH<br>$C_2H_5$ | " |

(Y-1)
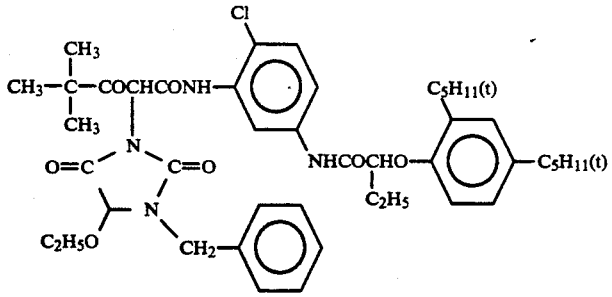
(Y-2)
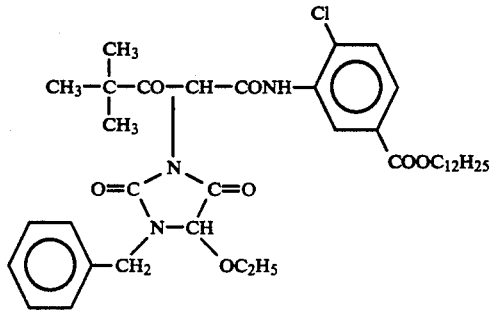
(Y-3)
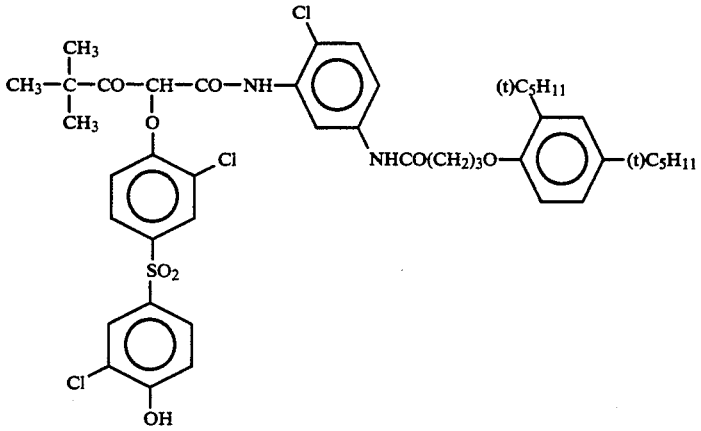
(Y-4)
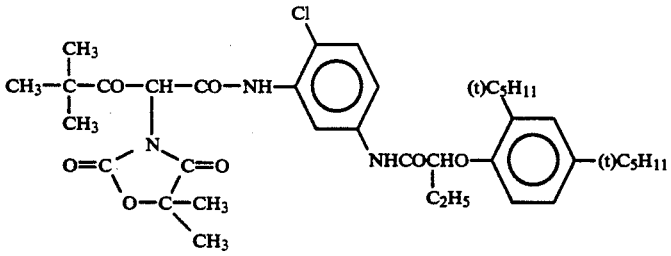
(Y-5)
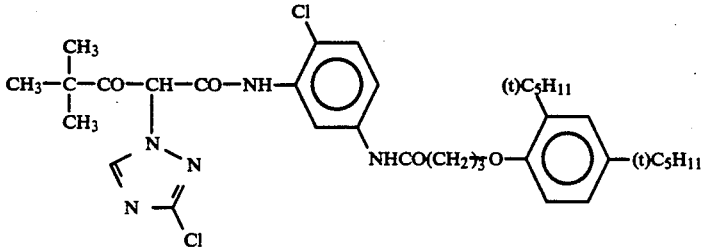

-continued (Y-6)

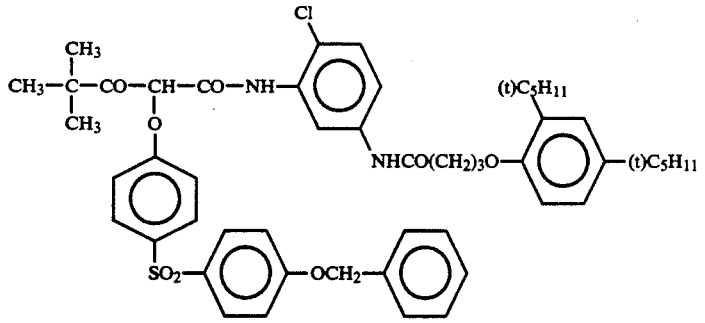

(Y-7)

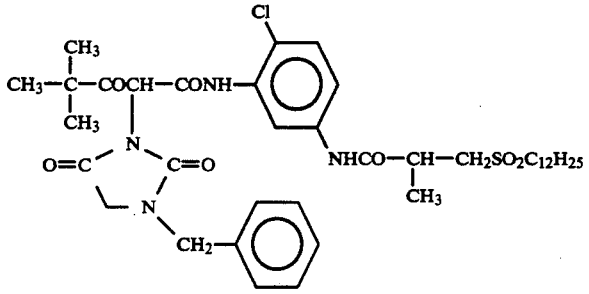

(Y-8)

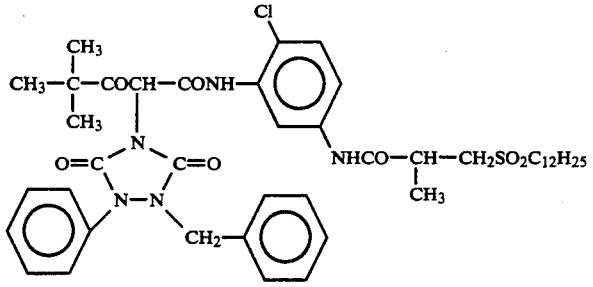

(Y-9)

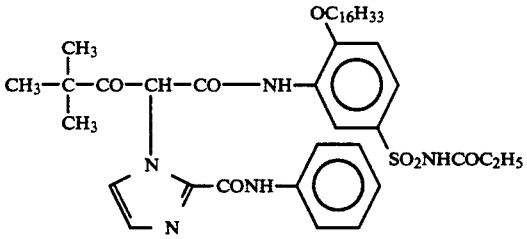

The couplers represented by the above-described general formulae (C-I) to (Y) are generally contained in silver halide emulsion layers constituting light-sensitive layers in an amount of 0.1 to 1.0 mol and preferably in an amount of 0.1 to 0.5 mol per mol of silver halide.

In the present invention, various techniques known in the art can be applied to add the above-described couplers to the light-sensitive layers. Usually the couplers can be added by oil-in-water dispersion methods known as oil protect methods, in which the couplers are dissolved in solvents, followed by emulsification in aqueous gelatin solutions containing surface active agents. Water or aqueous gelatin solutions may be added to the coupler solutions containing surface active agents to form oil-in- water dispersions with a phase inversion. Further, the alkali-soluble couplers can also be dispersed by the so- called Fisher dispersion method. The coupler dispersions may be mixed with photographic emulsions after low boiling organic solvents have been removed therefrom by distillation, noodle washing, ultrafiltration, or the like.

As such dispersion media for the couplers, high boiling organic solvents and/or water-insoluble polymer compounds having a dielectric constant (at 25° C) of 2 to 20 and a refractive index (at 25° C) of 1.5 to 1.7 are preferably used.

As the high boiling organic solvents, compounds represented by the following formulae (A) to (E) are preferably used.

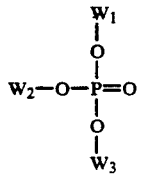

(A)

$W_1—COO—W_2$ (B)

-continued

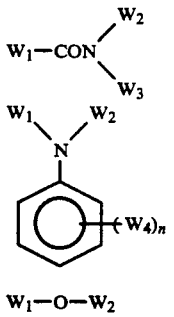

(C)

(D)

$W_1—O—W_2$ (E)

wherein each of $W_1$, $W_2$, and $W_3$ represents a substituted or unsubstituted alkyl, cycloalkyl, alkenyl, aryl, or heterocyclic group; $W_4$ represents $W_1$, $OW_1$ or $S—W_1$; n is an integer of 1 to 5; $W_4$ may be the same or different when n is 2 or more; and $W_1$ and $W_2$ may combine together to form a condensed ring in general formula (E).

High boiling solvents other than the solvents represented by general formulae (A) to (E) can be used in the present invention, as long as they are water-immiscible compounds having a melting point of not more than 100° C. and a boiling point of at least 140° C., and are good coupler solvents. The melting point of such high boiling solvents is preferably at least 160° C. and more preferably at least 170° C.

Details of these high boiling solvents are described on page 137, lower right column to page 144, upper right column of JP-A-62-215272.

Loadable latex polymers (for example, U.S. Pat. No. 4,203,716) can be impregnated with these couplers in the presence or in the absence of the above-described high boiling organic solvents, or the couplers can be dissolved in water-insoluble, organic solvent-soluble polymers to emulsify them in aqueous solutions of hydrophilic colloids.

The homopolymers or copolymers described on pages 12 to 30 of PCT International Publication No. W088/00723 are preferably used, and particularly the use of acrylamide polymers is preferable with respect to image stabilization.

The photographic materials according to the present invention may contain color antifoggants such as hydroquinone derivatives, aminophenol derivatives, gallic acid derivatives, and ascorbic acid derivatives.

The photographic materials according to the present invention may also contain various antifading agents. Namely, typical examples of organic antifading agents for cyan, magenta and/or yellow images include hindered phenols such as hydroquinones, 6-hydroxychromans, 5-hydroxycumarans, spirochromans, p-alkoxyphenols, and bisphenols; gallic acid derivatives; methylenedioxybenzenes; aminophenols; hindered amines; and ether or ester derivatives obtained by silylating or alkylating phenolic hydroxyl groups of these compounds. Further, metal complexes represented by (bis-salicylaldoximato)nickel complexes and (bis-N,N-dialkyldithiocarbamato)nickel complexes can also be used.

Specific examples of the organic antifading agents are described in the following patents.

The hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801 and 2,816,028, and British Patent 1,363,921. The 6-hydroxychromans, the 5-hydroxycoumarans, and the spirochromans are described in U.S. Pat. Nos. 3,432,300, 3,573,050, 3,574,627, 3,698,909 and 3,764,337, and JP-A-52-152225. The spiroindanes are described in U.S. Pat. No. 4,360,589. The p-alkoxyphenols are described in U.S. Pat. No. 2,735,765, British Patent 2,066,975, JP-A-59-10539 and JP-B-57-19765. The hindered phenols are described in U.S. Pat. Nos. 3,700,455 and 4,228,235, JP-A-52-72224, and JP-B-52- 6623. The gallic acid derivatives, the methylenedioxy- benzenes and the aminophenols are each described in U.S. Pat. Nos. 3,457,079 and 4,332,886 and JP-B-56-21144. The hindered amines are described in U.S. Pat. Nos. 3,336,135 and 4,268,593; British Patents 1,326,889, 1,354,313 and 1,410,846; JP-B-51-1420; JP-A-58-114036; JP-A-59-53846 and JP-A-59-78344. The metal complexes are described in U.S. Pat. Nos. 4,050,938 and 4,241,155 and British Patent 2,027,731(A). Each of these compounds is usually emulsified together with each corresponding color coupler in an amount of 5 to 100% by weight based on the weight of the coupler, and the resulting emulsion is added to the light-sensitive emulsion layer. In order to prevent cyan dye images from deteriorating due to heat and particularly light, it is more effective to introduce an ultraviolet absorber in a cyan color forming layer and layers on both sides adjacent thereto.

As ultraviolet absorbers, there can be used benzotriazole compounds substituted by aryl groups (for example, the compounds described in U.S. Pat. No. 3,533,794); 4-thiazolidone compounds (for example, the compounds described in U.S. Pat. Nos. 3,314,794 and 3,352,581); benzophenone compounds (for example, the compounds described in JP-A-46-2784); cinnamate compounds (for example, the compounds described in U.S. Pat. Nos. 3,705,805 and 3,707,395); butadiene compounds (for example, the compounds described in U.S. Pat. No. 4,045,229); and benzoxidol compounds (for example, the compounds described in U.S. Pat. Nos. 3,406,070, 3,677,672 and 4,271,307). Ultraviolet absorptive couplers (for example, α-naphthol cyan dye forming couplers) and ultraviolet absorptive polymers may also be used. These ultraviolet absorbers may also be mordanted to a specific layer.

In particular, the above-described benzotriazole compounds substituted by aryl groups are preferably used.

It is further preferred to use the following compounds in combination with the above-described couplers, particularly with the pyrazoloazole couplers.

Namely, from the viewpoint of the prevention of, for example, stain generation or other side effects caused by the formation of a color forming dye by reaction of a residual color forming developing agent or its oxidation product with the coupler during storage after processing, it is preferred to use simultaneously or separately a compound (F) which chemically combines with the aromatic amine developing agent remaining after color developing processing to form a compound which is chemically inactive and substantially colorless, and/or a compound (G) which chemically combines with the oxidation product of the aromatic amine developing agent to form a compound which is chemically inactive and substantially colorless.

Preferred examples of the compounds (F) include compounds which react with p-anisidine at a second order reaction rate constant $k_2$ (in trioctyl phosphate at 80° C.) of from 1.0 to $1\times10^{-5}$ l/mol sec. The second order reaction rate constant $k_2$ can be measured by the method described in JP-A-63-158545.

If the constant $k_2$ is higher than $1\times10^{-5}$ l/mol.sec, the compounds (F) themselves become unstable, and react with gelatin or water to decompose in some cases. On the other hand, if the constant $k_2$ is lower than 1.0 l/mol.sec, the reaction of the compounds (F) with the residual aromatic amine developing agent is sometimes too slow to prevent the side effects from the residual aromatic amine developing agent.

More preferred examples of such compounds (F) can be represented by the following general formula (FI) or F(II):

$$R_1-(A)_n-X \quad \text{(FI)}$$

$$R_2-\underset{\underset{B}{|}}{C}=Y \quad \text{(FII)}$$

wherein $R_1$ and $R_2$ each represent an aliphatic group, an aromatic group, or a heterocyclic group; n represents 1 or 0; A represents a group which reacts with an aromatic amine developing agent to form a chemical bond; X represents a group which is eliminated by a reaction with an aromatic amine developing agent; B represents a hydrogen atom, an aliphatic group, an aromatic group, a heterocyclic group, an acyl group, or a sulfonyl group; Y represents a group which promotes the addition of an aromatic amine developing agent to the compound represented by general formula (FII); and $R_1$ and X, or Y and $R_2$ or B may combine together to form a cyclic structure.

Typical reactions through which these compounds are chemically combined with the aromatic amine developing agents are a substitution reaction and an addition reaction.

Specific examples of the compounds represented by general formula (FI) or (FII), which are preferably used, are described in JP-A-63-158545, JP-A-62-283338, and European Patents 298321 and 277589.

Preferred examples of the compounds (G) which combine chemically with the oxidation products of aromatic amine developing agents remaining after color developing to form compounds which are chemically inactive and substantially colorless can be represented by the following general formula (GI):

$$R-Z \quad \text{(GI)}$$

wherein R represents an aliphatic group, an aromatic group, or a heterocyclic group; and Z represents a nucleophilic group or a group which decomposes in a photographic material to release a nucleophilic group. In the compounds represented by general formula (GI), it is preferred that Z is a group which is 5 or more in Pearson's nucleophilic $^{n}$CH3I value [R. G. Pearson et al., *J. Am. Chem. Soc.* 90, 319 (1968)], or a group derived therefrom.

Specific examples of the compounds represented by general formula (GI), that are preferably used, are described in European Patents 255722, 298321 and 277589; JP-A-62-143048; JP-A-62-229145; JP-A-1-57259; and Japanese Patent Application No. 63-136724.

The details of combinations of the above-described compounds (G) and compounds (F) are described in European Patent 277589.

In the photographic materials according to the present invention, the hydrophilic colloid layers may contain water-soluble dyes or dyes which become water-soluble by photographic processing, such as filter dyes, for the purpose of preventing irradiation or halation and for other various purposes. Such dyes include oxonol dyes, hemioxonol dyes, styryl dyes, merocyanine dyes, cyanine dyes, and azo dyes. In particular, the oxonol dyes, the hemioxonol dyes, and the merocyanine dyes are useful.

Gelatin can be advantageously used as a binder or a protective colloid for emulsion layers of the photographic material according to the present invention. However, hydrophilic colloids other than gelatin may also be used separately or in combination with gelatin.

When the hydrophilic colloids other than gelatin are used together with gelatin, the amount of gelatin contained in the total hydrophilic colloid is 50% by weight and preferably 80% by weight, as a dried solid.

As to gelatins used in the present invention, only the isoelectric point should be considered. The gelatins may be either treated with lime or treated with an acid. The details of the methods for preparing such gelatins are described in Arthur Vice, *The Macromolecular Chemistry of Gelatin* (Academic Press, 1964).

High-isoelectric point gelatins can be obtained by treating gelatins with an acid. Acids that can be used are hydrochloric acid, sulfuric acid, sulfurous acid, phosphoric acid, or a mixture thereof. Gelatin is generally treated by immersing it in a diluted solution of such an acid. Specifically, the method for preparing acid-treated gelatins from pig skins is described on page 186 of *The Macromolecular Chemistry of Gelatin* described above.

In addition, from the viewpoint of decreasing the amount of carboxyl groups and increasing the isoelectric point, the gelatins may be esterified (methyl esterified) or amidated (aminoethyl amidated).

Useful esterification methods include methyl esterification by the hydrochloric acid-methanol method described in H. Fraenkel-Conrat and H. S. Olcott, *J. Biol. Chem.* 161, 259 (1945); the thionyl chloride-methanol method described in J. Bello, *Biochim. Biophys. Acta.* 20, 426 (1956) and J. Bello, H. C. A. Riese and J. R. Vinograd, *J. Phys. Chem.* 60, 1299 (1956); the sulfuric acid-methanol method described in A. W. Kenchington, *Biochem. J.* 68, 458 (1958), and the hydrochloric acid-methanol method described in E. Klein, E. Moioar and E. Roche, *J. Photogr. Sci.* 19, 55 (1971) and Yasumasa Naganami, Hiroto Otaki and Harukazu Tyoda, *Leather Chemistry* 28, 33 (1982).

Useful amidation methods include amidation of gelatins using the water-soluble carbodiimides described in D. G. Hoare and D. E. Koshland Jr., *J. Am. Chem. Soc.* 88, 2057 (1966).

The isoelectric point of the gelatins used in the present invention is preferably at least 5.3 and more preferably at least 5.7. A upper limit of the isoelectric point is preferably 10.0. The gelatins having an isoelectric point of at least 5.3 which can be used in the present invention are used preferably used in an amount of at least 50% by weight of the total gelatin amount and more preferably in an amount of at least 70% by weight.

Examples of the hydrophilic colloids other than gelatin which can be used in the present invention include proteins such as gelatin derivatives; graft polymers of gelatin and other polymers, albumin and casein; cellulose derivatives such as hydroxyethyl cellulose, carboxymethyl cellulose, hydroxypropyl cellulose and cellulose sulfate; saccharide derivatives such as sodium alginate, polydextran, and starch derivatives; and synthetic hydrophilic polymeric substances consisting of homopolymers or copolymers thereof such as polyvinyl alcohols, partially acetalized polyvinyl alcohols, polyvinyl alcohols modified with anionic compounds and cationic compounds, poly-N-vinyl pyrrolidones, polyacrylic acids and neutralized products thereof, polymethacrylic acids and neutralized products thereof, polyacrylamides, polyvinylimidazoles, and polyvinylpyrazoles.

Of the above-described synthetic hydrophilic polymeric substances, polyvinyl alcohols, partially acetalized polyvinyl alcohols, polyvinyl alcohols modified with anionic compounds and cationic compounds, poly-N-vinyl pyrrolidones and polyacrylamides are particularly preferable in respect to interaction with EDTA-Fe(III).

The hydrophilic polymers containing the gelatins can be suitably crosslinked to increase initial swelling, and then used.

The amount of the gelatins contained in the total hydrophilic colloid used in the photographic materials is preferably 2.0 to 8.0 g/m$^2$, more preferably 2.0 to 6.0 g/m$^2$, and particularly preferably 3.5 to 6.0 g/m$^2$. Too much gelatin exerts unfavorable effects such as retardation of development, particularly of initial development, increased amounts of processing solution components introduced in the photographic materials, and a deterioration of the shelf life of the prints. On the other hand, too little gelatin has unfavorable effects such as deterioration in the physical property of the films in wetting and increased color turbidity of the images.

In the present invention, any of the hardening agents previously known in the art can be used alone or in combination.

Namely, there can be used, for example, chromium salts (such as chrome alum and chromium acetate); aldehydes (such as formaldehyde, glyoxal and glutaraldehyde); N-methylol compounds (such as dimethylolurea and methyloldimethyl-hydantoin); dioxane derivatives (such as 2,3-dihydroxydi-oxane); active vinyl compounds (such as 1,3,5-triacryloyl-hexahydro-2-triazine and 1,3-vinylsulfonyl-2-propanol); active halogen compounds (such as 2,4-dichloro-6-hydroxy-3-triazine); and mucohalogenic acids (such as mucochloric acid and mucophenoxychloric acid).

The hardening agents preferably used are aldehyde compounds (such as formaldehyde and glyoxal), s-triazine compounds (such as 2-hydroxy-4,6-dichlorotriazine sodium salt) and vinyl sulfone compounds.

The hardening agents are used preferably in an amount of $1\times10^{-6}$ to $1\times10^{-2}$ mol/g of gelatin and more preferably in an amount of $5\times10^{-5}$ to $5\times10^{-3}$ mol/g of gelatin, though affected by the presence of hardening accelerators or hardening retarders.

Typical examples of the hardening agents include the following compounds, but this invention is not to be limited to these.

HCHO H-1

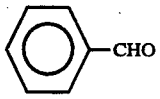
H-2

H-3

-continued $OHC\text{-}(CH_2)_3\text{-}CHO$ H-4

$CH_3CHO$ H-5

$ClCH_2CONHCOCH_2Cl$ H-6

$CH_3COCl$ H-7

$ClCH_2COOCH_2CH_2OOCCH_2Cl$ H-8

$CH_3COCH_2Cl$ H-9

H-10

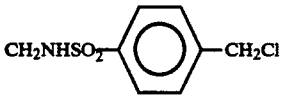

H-11

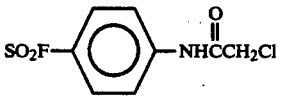

H-12

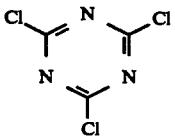

H-13

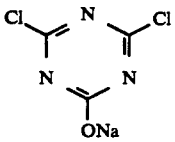

H-14

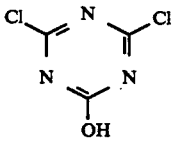

H-15

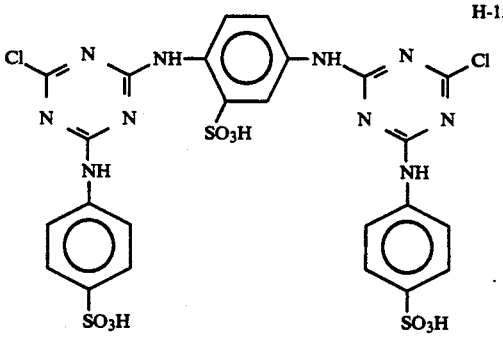

$CH_2{=}CHSO_2(CH_2)_3SO_2CH{=}CH_3$ H-16

$C(CH_2SO_2CH{=}CH_2)_4$ H-17

H-18

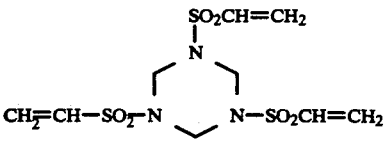

$(CH_2{=}CHSO_2\text{-}CH_2CONHCH_2)_2$ H-19

H-20

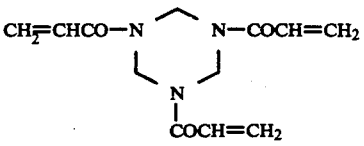

-continued $CH_2{=}CHCOOCOCH{=}CH_2$ H-21

$CH_2{=}CH{-}O{-}CH{=}CH_2$ H-22

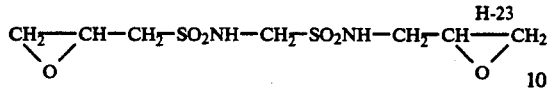
H-23

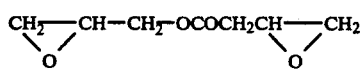
H-24

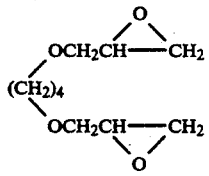
H-25

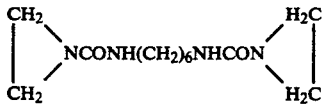
H-26

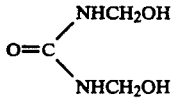
H-27

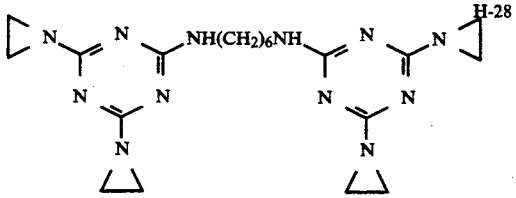
H-28

When these hardening agents are used to harden the hydrophilic colloids, hardening assistants may be used. The hardening assistants include hydrogen bond breaking agents such as thiourea and urea; and aromatic hydrocarbons having hydroxyl groups such as hydroquinone.

Further, an added layer can be exclusively hardened by polymerizing the hardening agent.

In the present invention, a transparent film such as a cellulose nitrate film or a polyethylene terephthalate film, or a reflecting support, which is usually used for photographic materials, can be used as the support. For the purpose of the present invention, it is more preferable to use the reflecting support.

The term "reflecting support" as used in the present invention means a support whose reflectivity is increased to clarify dye images formed on silver halide emulsion layers. Such supports include supports coated with hydrophobic resins containing light reflective materials such as titanium dioxide, zinc oxide, calcium carbonate, and calcium sulfate dispersed therein; and supports formed of hydrophobic resins containing light reflective materials dispersed therein. Examples thereof include paper such as baryta paper, polyethylene-coated paper and synthetic polypropylene paper, provided with reflective layers or containing reflective materials, and transparent supports such as glass plates; cellulose films such as a cellulose triacetate film and a cellulose nitrate film; polyester films such as a polyethylene terephthalate film; polyamide films, polycarbonate films; a polystyrene film; and a vinyl chloride resin.

As another reflecting support, a support having a metal surface as reflective as a mirror or a yielding a diffused reflection properties can be used. It is preferred that the metal surface is at least 0.5 in spectral reflectivity in the visible wavelength range and is roughened or converted to the surface of diffused reflection by using a metal powder. Such metal surfaces are made of aluminium, tin, silver, magnesium, and their alloys, for example. The metal surface may be formed of a metal plate, metal foil, or a thin metal layer, which is obtained by rolling, evaporation, or metal plating. In particular, evaporation of a metal onto a different substrate is preferable. It is preferred that a hydrophobic resin, particularly a thermoplastic resin, is provided on the metal surface. The support used in the present invention is preferably provided with an antistatic layer on the surface opposite the metal surface. The details of such a support are described in, for example, JP- A-61-210346, JP-A-63-24247, JP-A-63-24251, and JP-A-63-24255.

These supports can be suitably selected depending on their purpose.

The light reflective materials are preferably obtained by mixing sufficient white pigment in the presence of surfactants. It is preferred to use light reflective materials in which the surface of the pigment grains are treated with dihydric to tetrahydric alcohols.

Most typically, the occupied area ratio (%) of fine grains of a white pigment per specified unit area can be determined by dividing an observed area into 6 $\mu m \times 6$ $\mu m$ unit areas adjacent to one another and measuring the occupied area ratio (%) ($R_i$) of the fine grains projected into the unit areas. The coefficient of variation of the occupied area ratio (%) can be determined by the ratio $s/\overline{R}$ of the standard deviation s of $R_i$ to the mean value $\overline{R}$ of $R_i$. It is preferred that the number (n) of the unit areas measured is 6 or more. The coefficient of variation $s/\overline{R}$ can then be determined using the following formula:

$$\sqrt{\frac{\sum_{i=1}^{n}(R_i-\overline{R})^2}{n-1}} \Big/ \frac{\sum_{i=1}^{n} R_i}{n}$$

In the present invention, it is preferred that the coefficient of variation of the occupied area ratio (%) is 0.15 or less, particularly 0.12 or less. When the coefficient is 0.08 or less, the dispersibility of the grains can be said to be substantially "homogeneous".

It is preferred that color photographic materials according to the present invention be subjected to color developing, bleaching-fixing, and washing (or stabilizing processing). Bleaching and fixing may be carried out separately, not by the single bath process described above.

The color developing solutions used in the present invention contain aromatic primary amine color developing agents known in the art. Preferred examples of such color developing agents are p-phenylenediamine derivatives. Typical examples thereof include but are not limited to the following compounds.

(D-1) N,N-diethyl-p-phenylenediamine (D-2) 2-Amino-5-diethylaminotoluene (D-3) 2-Amino-5-(N-ethyl-N-laurylamino)toluene (D-4) 4-[N-ethyl-N-($\beta$-hydroxyethyl)amino]aniline (D-5) 2-Methyl-4-[N-ethyl-N-(β-hydroxyethyl-)amino]aniline (D-6) 4-Amino-3-methyl-N-ethyl-N-[β-(methanesulfonamido)ethyl]aniline (D-7) N-(2-amino-5-diethylaminophenylethyl)methanesulfonamide (D-8) N,N-dimethyl-p-phenylenediamine (D-9) 4-Amino-3-methyl-N-ethyl-N-methoxyethylaniline (D-10) 4-Amino-3-methyl-N-ethyl-N-β-ethoxyethylaniline (D-11) 4-Amino-3-methyl-N-ethyl-N-β-butoxyethylaniline Of the above-described p-phenylenediamine 2 derivatives, 4-amino-3-methyl-N-ethyl-N-[β-(methanesulfonamido)ethyl]-aniline [compound (D-6)] is particularly preferable.

These p-phenylenediamine derivatives may be salts such as sulfates, hydrochlorides, sulfites, and p-toluenesulfonates. The aromatic primary amine color developing agents are used preferably at a concentration of about 0.1 to about 20 g/l of developing solution, and more preferably at a concentration of about 0.5 to about 10 g/l of developing solution.

In carrying out this invention, it is preferred to use developing solutions substantially free from benzyl alcohol. Here, the developing solutions substantially free from benzyl alcohol mean developing solutions containing benzyl alcohol preferably at a concentration of not more than 2 ml/l, more preferably at a concentration of not more than 0.5 ml/l, and most preferably containing no benzyl alcohol at all.

It is more preferred that the developing solutions used in the present invention be substantially free from sulfite ions. Sulfite ions have the action of dissolving silver halides and reacting with oxidation products of developing agents to reduce dye forming efficiency, as well as acting as a preservative for the developing agents. Such action is presumed to be one of the causes of increased fluctuations in photographic properties by continuous processing. Here, "developing solutions substantially free from sulfite ions" mean developing solutions containing sulfite ions preferably at a concentration of not more than $3.0\times10^{-3}$ mol/l, and most preferably containing no sulfite ions at all, provided there is excluded the very small amount of sulfite ions used in processing agent kits in which the developing agents are concentrated prior to preparation of solutions to be used for the preparation of oxidation.

It is preferred that developing solutions used in the present invention be substantially free of sulfite ions, and further it is more preferred that the developing solutions be substantially free of hydroxylamine. This is because hydroxylamine itself has silver developing activity, as well as the function as a preservative for developing solutions. Fluctuations in the concentration of hydroxylamine are considered to exert a significant influence on photographic properties. Here, "developing solutions substantially free from hydroxylamine" means developing solutions containing hydroxylamine preferably at a concentration of not more than $5.0\times10^{-3}$ mol/l, and most preferably containing no hydroxylamine at all.

It is more preferred that the developing solutions used in the present invention contain organic preservatives in place of the above-described hydroxylamine or sulfite ions. Here, the "organic preservatives" means whole organic compounds which reduce the degradation speed of the aromatic primary amine color developing agents when added to the solution of color photographic materials. Namely, these are organic compounds having the function of preventing the color developing agents from oxidation with air or the like. In particular, effective organic preservatives are hydroxylamine derivatives (except hydroxylamine, the same applies hereinafter); hydroxamic acids; hydrazines; hydrazides; phenols; α-hydroxyketones; α-aminoketones; saccharides; monoamines; diamines; polyamines; quaternary ammonium salts; nitroxide radicals; alcohols; oximes; diamide compounds and condensed cyclic amines. These are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, JP-A-52-143020, JP-B-48-30496, and U.S. Pat. Nos. 3,615,503 and 2,494,903.

Other preservatives, may be used are such as various metals described in JP-A-57-44148 and JP-A-57-53749; salicylic acid derivatives described in JP-A-59-180588; alkanolamines described in JP-A-54-3532; polyethyleneimines described in JP-A-56-94349 and aromatic polyhydroxy compounds described in U.S. Pat. No. 3,746,544, as required. In particular, alkanolamines such as triethanolamine, dialkylhydroxylamines such as diethylhydroxylamine, and hydrazine derivatives or aromatic polyhydroxy compounds are preferably added.

Of the above-described preservatives, hydroxylamine derivatives and hydrazine derivatives (such as hydrazines and hydrazides) are particularly preferable. Details thereof are described in JP-A-1-97953, JP-A-1-186939, JP-A-186940, and JP-A-1-187557.

With respect to improving the stability of the color developing solutions, and also with respect to an improvement in the stability of continuous processing, it is more preferred that the above-described hydroxylamine derivatives or hydrazine derivatives be used in combination with amines.

The above-described amines include cyclic amines as described in JP-A-63-239447, amines described in JP-A-63-128340, and amines described in JP-A-1-186939 and JP-A-1-187557.

In the present invention, it is preferred that the color developing solution contains chlorine ions in an amount of $3.5\times10^{-2}$ to $1.5\times10^{-1}$ mol/l, particularly in an amount of $4\times10^{-2}$ to $1\times10^{-1}$ mol/l. If the concentration of chlorine ions is higher than $1.5\times10^{-1}$ mol/l, development is disadvantageously retarded, which is unfavorable for attaining the object of the present invention, that processing is rapid and the maximum concentration is high. A concentration lower than $3.5\times10^{-2}$ mol/l is unfavorable for prevention of fogging.

In the present invention, it is preferred that the color developing solution contains bromine ions in an amount of $3.0\times10^{-5}$ to $1.0\times10^{-3}$ mol/l, particularly in an amount of $5.0\times10^{-5}$ to $5.0\times10^{-4}$ mol/l. If the concentration of bromine ions is higher than $1.0\times10^{-3}$ mol/l, development is retarded, and the maximum concentration and the sensitivity are decreased. If the concentration is lower than $3.0\times10^{-5}$ mol/l, fogging cannot be sufficiently prevented.

The chlorine ions and the bromine ions may be directly added to the developing solutions, or they may be eluted from the photographic materials to the developing solutions.

When chlorine ions are directly added to the color developing solutions, chlorine ion supply materials include sodium chloride, potassium chloride, ammonium chloride, lithium chloride, nickel chloride, magnesium chloride, manganese chloride, calcium chloride, and cadmium chloride. Of these materials, sodium chloride and potassium chloride are preferably used.

Chlorine ions may also be supplied from fluorescent brighteners added to the developing solutions.

Bromine ion supply materials include sodium bromide, potassium bromide, ammonium bromide, lithium bromide, calcium bromide, magnesium bromide, manganese bromide, nickel bromide, cadmium bromide, cerium bromide and thallium bromide. Of these materials, potassium bromide, and sodium bromide are preferably used.

When the chlorine ions and the bromine ions are eluted from the photographic materials during developing processing, both of them may be supplied from the emulsions or materials other than the emulsions.

The pH of the color developing solutions used in the present invention is preferably 9 to 12 and more preferably 9 to 11. Other known constituent compounds of color developing solutions can be added to the above color developing solutions.

It is preferred to use various buffers to maintain the above-described pH. As buffers, there can be used carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. In particular, carbonates, phosphates, tetraborates, and hydroxybenzoates have the advantages of being excellent in solubility and in buffering ability in the high pH region of 9.0 or more, exerting no adverse effect on photographic properties (such as fogging) when added to the color developing solutions, and being inexpensive. It is therefore particularly preferred to use these buffers.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the buffers used in the present invention are not limited to these compounds.

The above buffers are added to the color developing solutions preferably in an amount of at least 0.1 mol/l, and particularly preferably in an amount of 0.1 to 0.4 mol/l.

In addition, various chelating agents can be used in the color developing solutions as suspending agents for calcium or magnesium, or to improve the stability of the color developing solutions. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycoletherdiaminetetraacetic acid, ethylenediamine-o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

Two or more kinds of these chelating agents may be used in combination, as required.

These chelating agents may be added in any amount as long as the amount is enough to block metal ions in the color developing solutions. For example, they can be added in an amount of about 0.1 to 10 g/l.

Any development accelerators may be added to the color developing solutions as desired. Such development accelerators include thioether compounds described in JP-B-37-16088, JP-B-37-5987, JP-B-38-7826, JP-B-44-12380, JP-B-45-9019, and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796, 3,253,919, 2,482,546, 2,596,926 and 3,582,346 and JP-B-41-11431; polyalkylene oxides described in JP-B-37-16088, JP-B-42-25201, U.S. Pat. No. 3,128,183, JP-B-41-11431, JP-B-42-23883 and U.S. Pat. No. 3,532,501; 1-phenyl-3-pyrazolidone compounds; and imidazole compounds.

In the present invention, any antifoggants may be added, as desired. As the antifoggants, there can be used alkaline metal halides such as sodium chloride, potassium bromide, potassium iodide; and organic antifoggants. Typical examples of the antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

It is preferred that the color developing solutions used in the present invention contain fluorescent brighteners. As the fluorescent brighteners, 4,4'-diamino-2,2'-disulfostilbene compounds are preferably used. They are added in an amount of 0 to 5 g/l, and preferably in an amount of 0.1 to 4 g/l.

There may be further added various surface active agents such as alkylsulfonic acids, arylphosphonic acids, aliphatic carboxylic acids and aromatic carboxylic acids, as desired.

The processing temperature of the color developing solutions applied to the present invention is 20° to 50° C. and preferably 30° to 40° C. The processing time is within about 20 seconds and lower limit is 5 seconds. It is preferred that the replenishment rate of the color developing solutions is minimized. The replenishment rate is for example, from 20 to 600 ml/m$^2$ of photographic material, preferably 50 to 300 ml/m$^2$, more preferably 60 to 200 ml/m$^2$, and most preferably 60 to 150 ml/m$^2$.

In the present invention, the developing time is about 20 seconds. The phrase "about 20 seconds" means the time needed from the time the photographic material enters a developing solution tank until it enters the next tank, and includes the time for which the photographic material travels in the air from the developing solution tank to the next tank.

Next, a desilverization stage applied to the present invention is described. The desilverization stage may be carried out by using any of the following sequences: bleaching stage- fixing stage; the fixing stage-bleaching-fixing stage; bleaching stage- bleaching-fixing stage; and bleaching-fixing stage.

The bleaching solutions, the bleaching-fixing solutions and the fixing solutions applied to the present invention are described below.

Any bleaching agent can be used in the bleaching solutions or the bleaching-fixing solutions. In particular, there are preferably used organic complexes of iron(III) (for example, complex salts of iron(III) with aminopolycarboxylic acids such as ethylenediaminetetraacetic acid and diethylenetriamine-pentaacetic acid, aminopolyphosphonic acids, phosphono-carboxylic acids and organic phosphonic acids); organic acids (such as citric acid, tartaric acid and malic acid); persulfates; and hydrogen peroxide.

Of these, the organic complex salts of iron(III) are preferable from the viewpoint of rapid processing and prevention of environmental pollution. Aminopoly-carboxylic acids, aminopolyphosphonic acids, and organic phosphonic acids useful for formation of useful organic complex salts of iron(III) include ethylenediaminetetraacetic acid; diethylenetriaminepentaacetic acid; 1,3-diaminopropanetetraacetic acid; propylenediaminetetraacetic acid; nitrilotriacetic acid; cyclohexanediaminetetraacetic acid; methyliminodiacetic acid; iminodiacetic acid and glycoletherdiaminetetraacetic acid. There may also be used salts of these compounds such as these formed with sodium, potassium, lithium, and ammonia. Of these compounds, the complex salts of iron(III) with ethylenediaminetetraacetic acid, diethylenetriaminepentaacetic acid; cyclohexanediaminetetraacetic acid; 1,3-diaminopropanetetraacetic acid; and methyliminodiacetic acid are preferable because of their high bleaching ability. These complex salts of iron(III) may be used in the form of complex salts, or they may be formed in the solutions by using ferric salts such as ferric sulfate, ferric chloride, ferric nitrate, ammonium ferric sulfate, and ferric phosphate; and a chelating agent such as the aminopolycarboxylic acids, aminopolyphosphonic acids, and phosphonocarboxylic acids. Chelating agent may be used in an excessive amount that is than the equivalent amount for formation of the complex salts of iron(III). Of the iron complexes, the iron complexes with the aminopolycarboxylic acids are preferably used. These are added in an amount of 0.01 to 1.0 mol/l, and preferably in an amount of 0.05 to 0.50 mol/l.

Various compounds may be added as bleaching promoters to the bleaching solutions, the bleaching-fixing solutions, and/or the preceding baths thereof. There are preferably used, for example, the compounds having mercapto groups or disulfide linkages described in U.S. Pat. No. 3.893.858, West German Patent 1,290,812, JP-A-53-95630 and *Research Disclosure* No. 17129 (July, 1978); the thiourea compounds described in JP-B-45-8506, JP-A-52-20832, JP-A-53-32735 and U.S. Pat. No. 3,706,561; and halides providing iodine ions or bromine ions because all are excellent in bleaching ability.

In addition, the bleaching solutions or bleaching-fixing solutions used in the present invention may contain rehalogenating agents such as bromides (for example, potassium bromide, sodium bromide, and ammonium bromide), chlorides (for example, potassium chloride, sodium chloride, and ammonium chloride) and iodides (for example, ammonium iodide). As desired, there can be added one or more kinds of inorganic acids, organic acids, and alkali metal or ammonium salts thereof having pH buffering ability such as borax, sodium metaborate, acetic acid, sodium acetate, sodium carbonate, potassium carbonate, phosphorous acid, phosphoric acid, sodium phosphate, citric acid, sodium citrate, and tartaric acid; or corrosion inhibitors such as ammonium nitrate and guanidine. Fixing agents used in the bleaching-fixing solutions or the fixing solutions are fixing agents known in the art, namely, water-soluble silver halide dissolving agents such as thiosulfates (for example, sodium thiosulfate and ammonium thiosulfate); thiocyanates (for example, sodium thiocyanate and ammonium thiocyanate); thioether compounds (for example, ethylenebisthioglycollic acid and 3,6-dithia- 1,8-octanediol); and thioureas. These compounds may be used alone, or two or more kinds of them mixed together may be used. There can also be used a special bleaching-fixing solution prepared as a combination of the fixing agent described in JP-A-55-155354 and a large amount of a halide such as potassium iodide. In the present invention, the thiosulfates are preferably used, particularly, ammonium thiosulfate. Fixing agents are preferably used in an amount of 0.3 to 2 mols/l, and more preferably in an amount of 0.5 to 1.0 mol/l. The pH range of the bleaching-fixing solutions or the fixing solutions is preferably 3 to 10 and more preferably 5 to 9.

The bleaching-fixing solutions may further contain various fluorescent brighteners, antifoaming agents, surface active agents, and organic solvents such as polyvinyl pyrrolidone and methanol.

It is preferred that the bleaching-fixing solutions or the fixing solutions contain sulfite ion-releasing compounds such as sulfites (for example, sodium sulfite, potassium sulfite and ammonium sulfite); bisulfites (for example, ammonium bisulfite, sodium bisulfite and potassium bisulfite); and metabisulfites (for example, potassium metabisulfite, sodium metabisulfite and ammonium metabisulfite). These compounds are contained preferably in an amount of about 0.02 to 0.05 mol/l and more preferably in an amount of 0.04 to 0.40 mol/l, which is converted to the amount of sulfite ions.

As preservatives, sulfites can be generally added. In addition, there may be added ascorbic acid, carbonyl bisulfite addition compounds, or carbonyl compounds.

Buffers, fluorescent brighteners, chelating agents, antifoaming agents, antifungal agents or the like may also be added if so desired.

The silver halide color photographic materials are usually subjected to washing and/or stabilization processing after desilverization.

The amount of rinsing water used in the washing stage can be widely established depending on the characteristics of the photographic materials (for example, depending on materials used such as couplers), their use, the temperature of the rinsing water, the number of rinsing tanks (the number of stages), and other various conditions. Of these, the relationship between the amount of the rinsing water and the number of the rinsing tanks in the multistage countercurrent system can be determined by the method described in *Journal of the Society of Motion Picture and Television Engineers* 64, 248–253 (May, 1955). The number of the stages in the multistage countercurrent system is preferably 2 to 6 and particularly preferably 2 to 5.

According to the multistage countercurrent system, the amount of the rinsing water can be substantially reduced. For example, the amount of the rinsing water can be reduced to 300 ml per $m^2$ of photographic material. The effect of the present invention is remarkable in this point. However, the increased residence time of the rinsing water in the tanks produces the problem that bacteria propagate in the water and the resulting suspended matter adheres to the photographic materials. In order to solve such a problem, the method for reducing calcium and magnesium described in JP-A-62-288838 can be very effectively used. There can also be used the isothiazolone compounds and the thiabendazoles described in JP-A-57-8542; chlorine disinfectants such as chlorinated sodium isocyanurate described in JP-A-61-120145; benzotriazole described in JP-A-61-267761; and the copper ions and the disinfectants as described in Hiroshi Horiguchi, *Chemistry of Bacteria Prevention and Fungus Prevention,* Sankyo Shuppan (1986), *Sterilization, Pasteurization and Fungus Prevention Techniques of Microorganisms,* edited by Eisei Gijutsukai, Kogyo Gijutsukai (1982) and *Dictionary of Disinfectants and Fungicides,* edited by Nippon Bohkin Bohbai Gakkai (1986).

In addition, surface active agents can be used as wetting agents in the rinsing water, and chelating agents represented by EDTA as water softeners.

The photographic materials can be treated successively to the washing stage described above or directly with stabilizing solutions without passing through the washing stage. Compounds having image stabilizing functions are added to the stabilizing solutions. Examples of such compounds include aldehyde compounds represented by formalin; buffers to adjust the films to the pH suitable for dye stabilization; and ammonium compounds.

In order to prevent bacteria from proliferating in the solutions and give antifungal properties to the treated photographic materials, the above-described various disinfectants and antifungal agents can be used.

In addition, surface active agents, fluorescent brighteners, or hardening agents may be added to the stabilizing solutions. In processing the photographic materials according to the present invention, when stabilization is directly performed without passing through the washing stage, all of the methods described in JP-A-57-8543, JP-A-58-14834, and JP-A-60-220345 can be used.

The organic phosphonic acids and/or the organic phosphonates are represented by the following general formulae (I) to (IV).

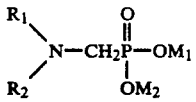

(I)

In general formula (I), $M_1$ and $M_2$ each represent a hydrogen atom or a cation giving water solubility (for example, an alkali metal ion such as a sodium ion or a potassium ion; an ammonium ion; a pyridinium ion; a triethanolammonium ion; or a triethylammonium ion); $R_1$ and $R_2$ each represent an alkyl group having 1 to 4 carbon atoms (for example, methyl, ethyl, propyl, isopropyl, or butyl), an aryl group [for example, phenyl, o-tolyl, m-tolyl, p-tolyl, p-carboxyphenyl or a water-soluble salt of p-carboxyphenyl (for example, a sodium salt, or a potassium salt)], an aralkyl group (for example, benzyl, β-phenethyl or o-acetamidobenzyl, and an aralkyl group having 7 to 9 carbon atoms is particularly preferable), an alicyclic group (for example, cyclohexyl, or cyclopentyl), a heterocyclic group (for example, pyrrolyldimethyl, pyrrolidylbutyl, benzothiazoylmethyl, or tetrahydroquinolylmethyl; and $R_1$ and $R_2$ (desirably when it is an alkyl group) may each be substituted for an hydroxyl group, a carboxyl group, an alkoxy group (for example, methoxy, or ethoxy), a halogen atom (for example, chlorine),

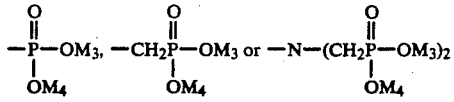

(wherein $M_3$ and $M_4$ have the same meanings as $M_1$ and $M_2$ described above.

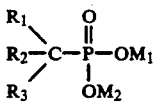

(II)

In general formula (II), $M_1$ and $M_2$ have the same meanings as defined in general formula (I); $R_1$ represents a hydrogen atom, each of an alkyl group, an aralkyl group, an alicyclic group, and a heterocyclic group which are defined in general formula (I),

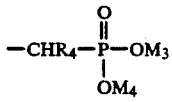

(wherein $R_4$ represents a hydrogen atom, a hydroxyl group, or an alkyl group), or

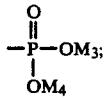

and $R_2$ and $R_3$ each represent a hydrogen atom, a hydroxyl group, a carboxyl group, an alkyl group, a substituted alkyl group defined in general formula (I), or

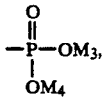

wherein $M_3$ and $M_4$ have the same meanings as $M_1$ and $M_2$ described above.

Above all, $R_2$ preferably represents

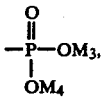

$R_3$ preferably represents a hydroxyl group or

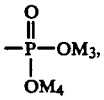

and $R_1$ preferably represents hydrogen atom, an alkyl group defined in formula (I), or

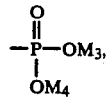

and more preferably hydrogen atom, an alkyl group unsubstituted or substituted by

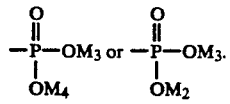

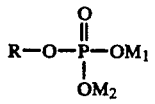

(III)

In general formula (III), $M_1$ and $M_2$ have the same meanings as defined in general formula (I); R represents a hydrogen atom, each of an alkyl group, an alicyclic group and heterocyclic group which are defined in general formula (I) or

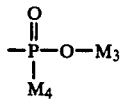

(wherein $M_3$ and $M_4$ have the same meanings as $M_1$ and $M_2$).

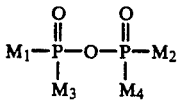

(IV)

In general formula (IV), $M_1$, $M_2$, $M_3$, and $M_4$ each have the same meaning as $M_1$ and $M_2$ defined in general formula (I), and further it is preferred that $M_3$ and $M_4$ are each a hydroxyl group.

Examples of the compounds represented by general formula (I) are shown below.

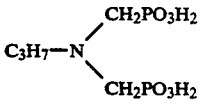

(1)

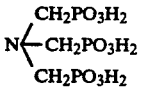

(2)

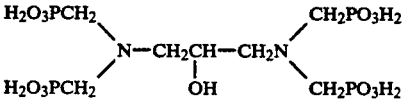

(3)

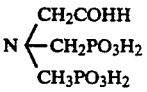

(4)

-continued

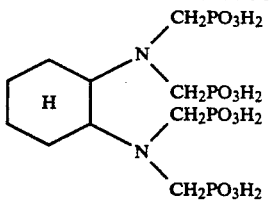

(5)

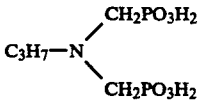

(6)

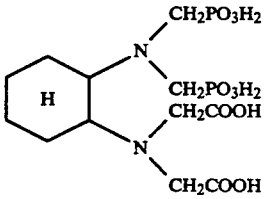

(7)

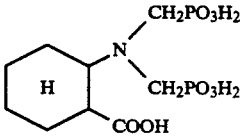

(8)

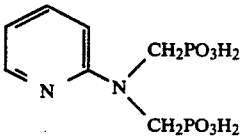

(9)

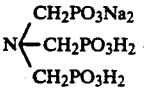

(10)

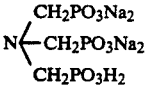

(11)

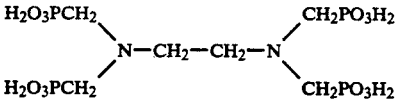

(12)

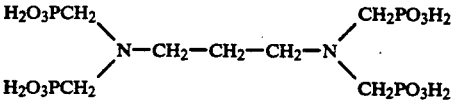

(13)

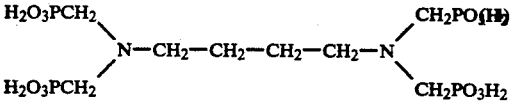

Examples of the compounds represented by general formula (II) are shown below.

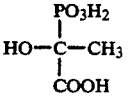

(15)

-continued
(16)
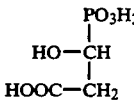
(17)
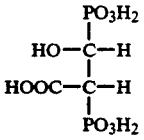
(18)
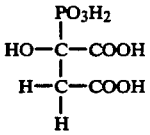
(19)
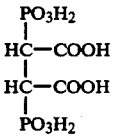
(20)
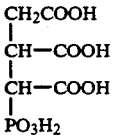
(21)
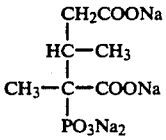
(22)
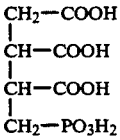
(23)
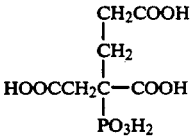
(24)
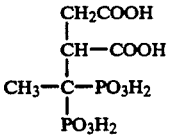
(25)
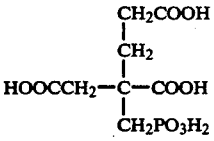
(26)
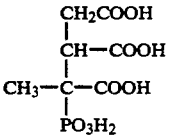
-continued
(27)
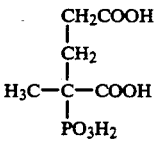
(28)
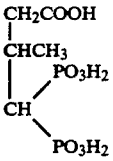
(29)
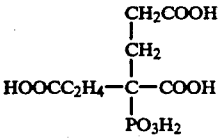
(30)
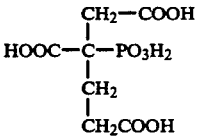
(31)
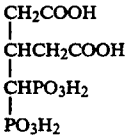
(32)
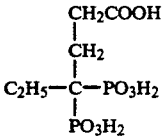
(33)
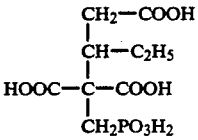
(34)
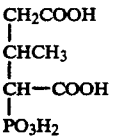
(35)
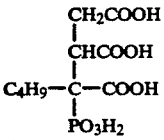
(36)
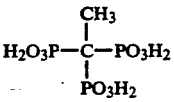
(37)
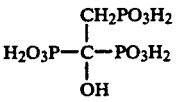

-continued
(38)
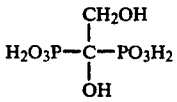
(39)
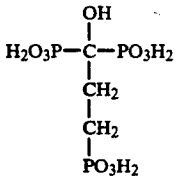
(40)
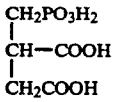
(41)
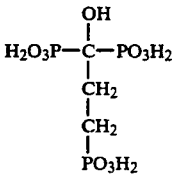
(42)
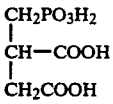
(43)
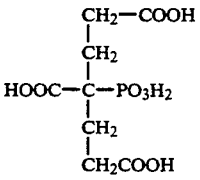
(44)
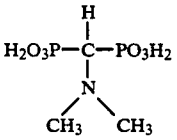
(45)
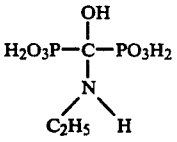
(46)
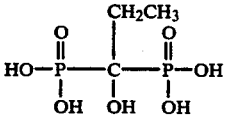
(47)
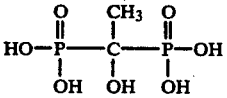
(48)
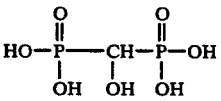
-continued
(49)
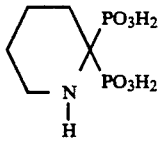
(50)
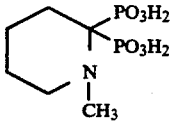
(51)
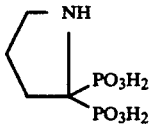
(52)
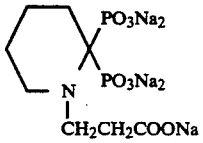
Examples of the compounds represented by general formula (III) are shown below.
(53)
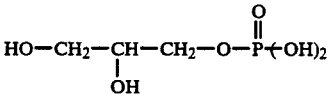
(54)
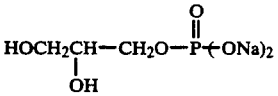
(55)
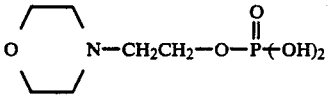
(56)
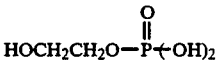
(57)
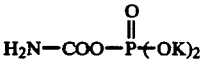
(58)
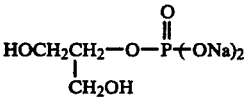
(59)
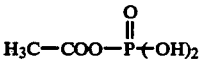
(60)
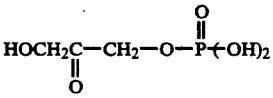

-continued (61)

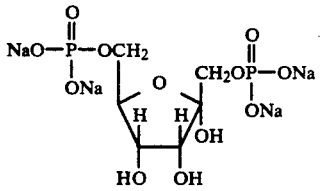

(62)

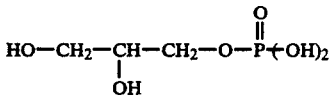

(63)

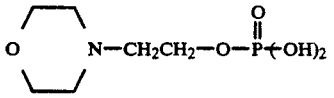

(64)

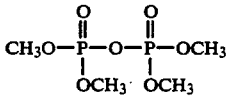

(65)

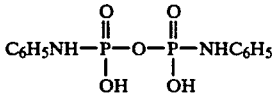

(66)

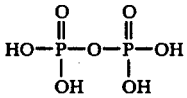

(67)

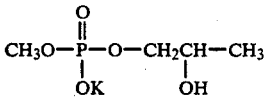

(68)

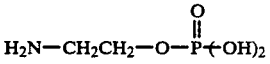

(69)

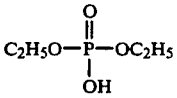

(70)

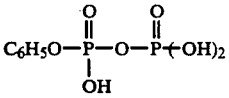

(71)

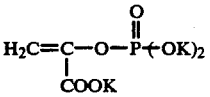

(72)

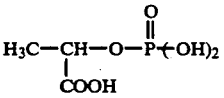

(73)

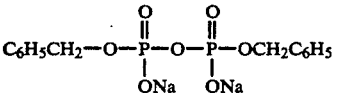

(74)

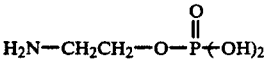

-continued (75)

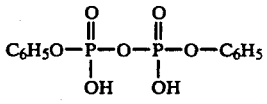

(76)

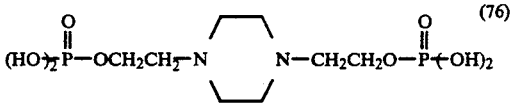

(77)

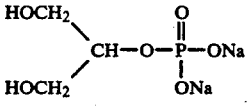

(78)

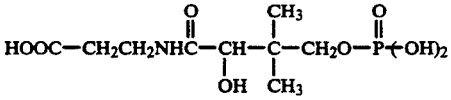

(79)

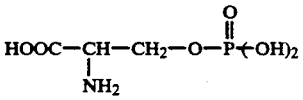

(80)

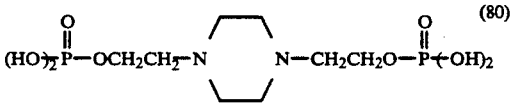

(81)

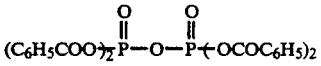

(82)

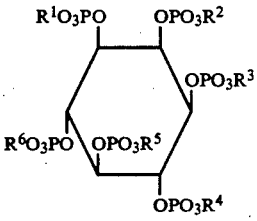

$R^1 \sim R^6$ = 9Na, 3H

Examples of the compounds represented by general formula (IV) are shown below.

(83)

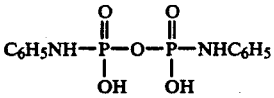

(84)

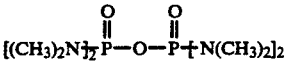

Of the above-described compounds, particularly effective compounds are those compounds represented by general formula (II). In particular, compounds (36), (39), (41), (46), (47) and (48) are preferable.

These organic phosphonic acids or/and organic phosphonates may be used alone, or two or more kinds of them may be used in combination.

The amount of these organic phosphonic acids or/and organic phosphonates added to the washing bath or the stabilizing bath can be determined depending on the amount of ethylenediaminetetraacetic acid Fe (III) contained in the photographic materials. It is, however, preferable to use 2.9 to 290 mmols per l of washing bath or stabilizing bath. More preferably, is 14.6 to 146 mmols/l. If the organic phosphonic acids or/and the organic phosphonates are added in too large amounts, the surfaces of the photographic materials are likely to become sticky. Conversely, if they are added in too small amounts, the essential effect of improving stains cannot be obtained.

Further, the use of magnesium or bismuth compounds is a preferred embodiment.

In addition, the use of chelating compounds such as 1-hydroxyethylidene-1,1-diphosphonic acid and ethylenediaminetetramethylenephosphonic acid, magnesium or bismuth compounds is also a preferred.

As the washing solutions or the stabilizing solutions used after desilverization, so-called .rinsing solutions can be similarly used.

The pH of the rinsing solutions or the stabilizing solutions is preferably 4 to 10 and more preferably 5 to 8. The temperature thereof can be variously established depending on the use of the photographic sensitive materials and the characteristics thereof. In general, however, a temperature of 30° to 45° C., preferably 35° to 42° C., is preferably used. The time required for processing can be arbitrarily established, but a shorter time is preferable from the viewpoint of reduction in processing time. The time is therefore preferably 10 to 45 seconds and more preferably 10 to 40 seconds. It is preferred from the viewpoints of running cost, a reduction in discharge and processability that the replenishment rate is shorter.

The specific preferred replenishment rate is 0.5 to 50 times, and preferably 2 to 15 times, the amount of the solution introduced from the preceding bath per unit area of photographic material; or not more than 300 $ml/m^2$ and preferably not more than 150 $ml/m^2$ of photographic material. The replenishment may be carried out continuously or intermittently.

The solution used in the washing stage and/or the stabilizing stage can be further used in the preceding stage. Examples thereof include the method of introducing overflowed rinsing water decreased by the multistage countercurrent system into the preceding bath, the bleaching-fixing bath, and replenishing the bleaching-fixing bath with a concentrated solution, thereby reducing the amount of waste liquid.

Drying procedures applicable to the present invention are hereinafter described.

The drying time is also desired to be 10 to 40 seconds in order to complete the images using the very rapid processing of the present invention.

The drying time can be shortened by decreasing the amount of the hydrophilic binder, such as a gelatin, contained in the photographic material to reduce the amount of water introduced in the film. From the viewpoint of reduction in the amount of introduced water, it is also possible to speed up drying by absorbing water with squeezing rollers or cloth immediately after the photographic material leaves the washing bath. It is of course possible to speed up drying by elevating the temperature of a dryer or by increasing the force of blown drying air. Drying can also be accelerated by adjusting the angle of the drying air brown on the photographic material and by method of removing blown air.

The present invention will be further illustrated in greater detail with reference to the following examples, which are, however, not to be construed as limiting the invention. All percentage and ratios are by weight unless otherwise indicated.

EXAMPLE 1

Gelatins used in the present invention are prepared by the following methods. For the details of methods for preparing the gelatins, reference was made to the methods described in Arthur Vice, *The Macromolecular Chemistry of Gelatin* (Academic Press, 1964).

Preparation of GEL-1

A pig skin was immersed in a 3% hydrochloric acid solution for 24 hours, and excess acid was removed with water. Extraction was conducted at a temperature of 50° C. at pH of 4.1, followed by discharge of the extracted solution. The residual raw material was extracted at a temperature of 65° C. for 4 hours. This operation was repeated 5 times (the temperature was elevated by 5° C. each time, and the temperature of the final extraction reached 85° C.) to obtain a crude gelatin. The crude gelatin was purified by filtration and desalting, and subjected to concentrating, freezing, and drying stages to prepare GEL-1.

The viscosity of the resulting gelatin was 60 mp, when measured according to the PUGI method at a concentration of 6.67% at a temperature of 40° C. The conductivity measured by the PUGI method was 700 s/cm (2% solution, 25° C.). The isoelectric point as measured by the PUGI method was 9.0.

Preparation of GEL-2

GEL-2 was prepared in the same manner as with GEL-1, except the extraction was conducted at a pH of 4.8 and the filtration time and the desalting time were quadrupled. When measured by the PUGI method, the viscosity was 41 mp, the conductivity 90 μs/cm, and the isoelectric point 6.5.

Preparation of GEL-3 (Comparative Example)

A bovine bone was crushed, and immersed in a 5% hydrochloric acid solution at a temperature of 20° C. for 7 days, followed by removal of excess acid with water. The bone thus treated was immersed in a 3% calcium hydroxide solution (pH 12.5) at a temperature of 17° C. for 70 days. The resulting sample was extracted at a temperature of 60° C. at a pH of 5.9 for 2 hours, followed by discharge of the extracted solution. The residual raw material was extracted at a temperature of 70° C. for 3 hours. This operation was carried out at 80° C. for 4 hours, and further at 95° C. for 4 hours to obtain a crude gelatin. The crude gelatin was purified by filtration and desalting, and subjected to concentrating, freezing, and drying stages to prepare GEL-3. When measured by the PUGI method, the viscosity was 64 mp, the conductivity 250 μs/cm, and the isoelectric point 5.0.

Preparation of GEL-4

To 10 g of the above GEL-3 was added 1000 ml of methanol to form a suspension. Concentrated hydrochloric acid was added thereto to a concentration of 0.05N, followed by standing with occasional stirring at room temperature for 3 days. The resulting product was washed with a large amount of water and dried to obtain an esterified gelatin (GEL-4). The isoelectric point of this gelatin was 5.5.

Preparation of GEL-5

To 10 g of GEL-3 was added 1000 ml of water to form an aqueous solution. 1.0M 1-ethyl-3-(3-dimethylaminopropyl)- carbodiimide and 0.1N 1-ethylenediamine were added thereto, and the mixture was allowed to stand at 25° C. at a pH of 4.75 for 16 hours. The product was dried to obtain an aminoethyl amidated gelatin (GEL-5). The isoelectric point of this gelatin was 5.4.

Preparation of Sample 101

A paper support, both sides of which were laminated with polyethylene, was coated with the following layers to prepare a sheet of multilayer color photographic paper. Coating solutions were prepared as follows.

As a gelatin used in preparing emulsions and the coating solutions, GEL-1 was used.

Preparation of Coating Solution for First Layer 27.2 cc of ethyl acetate and 8.2 g of solvent (Solv-1) were added to 19.1 g of yellow coupler (ExY); to dissolve them 4.4 g of color image stabilizer (Cpd-1), and 0.7 g of color image stabilizer-(Cpd-7) were added. The resulting solution was emulsified and dispersed in 185 cc of 10% gelatin solution containing 8 cc of 10% sodium dodecylbenzenesulfonate.

The following blue-sensitizing dye was added, in an amount of $2.0 \times 10^{-4}$ mol per mol of silver for a large-sized emulsion, and in an amount of $2.5 \times 10^{-4}$ mol per mol of silver for a small-sized emulsion, to a silver chlorobromide emulsion (cubic, a 3:7 mixture (silver mol ratio) of an emulsion of 0.88 μm in mean grain size and an emulsion of 0.70 μm in mean grain size, coefficients of variation in grain size distribution for the respective emulsions being 0.08 and 0.10, each emulsion containing 0.2 mol% of silver bromide localized on the surfaces of grains), followed by sulfur sensitizing to prepare an emulsion. The above-described emulsified dispersion and this emulsion were mixed with each other to prepare a coating solution for a first layer so as to have the following composition.

Coating solutions for second to seventh layers were prepared as with the coating solution for the first layer.

As a gelatin hardener for each layer, the sodium salt of 1-oxy-3,5-dichloro-s-triazine was used.

As color sensitizing dyes for the respective layers, the following dyes were used.

Dyes for Blue-Sensitive Emulsion Layer:

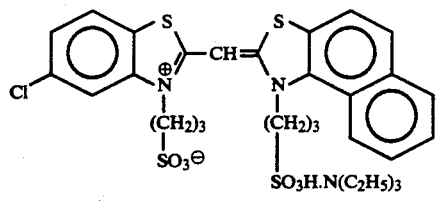

and

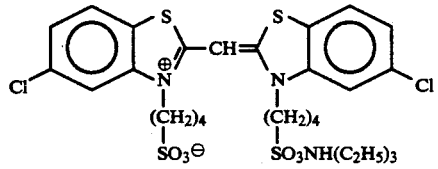

($2.0 \times 10^{-4}$ mol per mol of silver halide, respectively, for a large-sized emulsion, and $2.5 \times 10^{-4}$ mol per mol of silver halide, respectively, for a small-sized emulsion)

Dyes for Green-Sensitive Emulsion Layer:

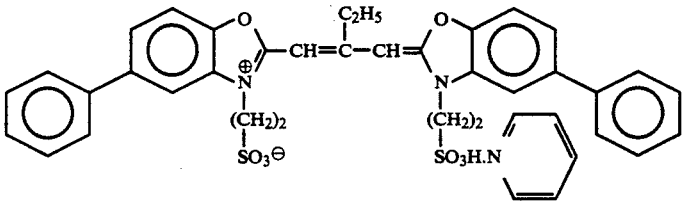

($4.0 \times 10^{-4}$ mol per mol of silver halide, for a large-sized emulsion, and $5.6 \times 10^{-4}$ mol per mol of silver halide, for a small- sized emulsion), and

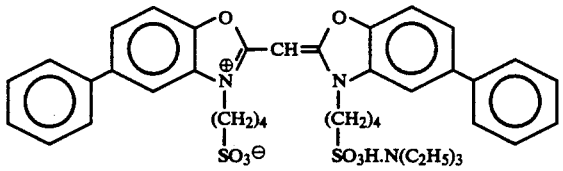

($7.0 \times 10^{-5}$ mol per mol of silver halide, for a large-sized emulsion, and $1.0 \times 10^{-5}$ mol per mol of silver halide, for a small- sized emulsion)

Dye for Red-Sensitive Emulsion Layer:

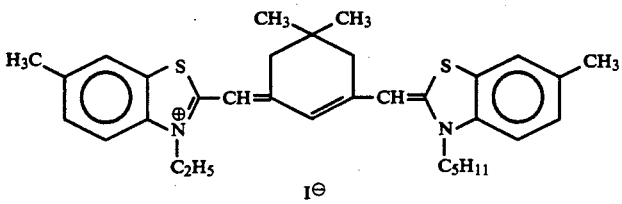

($0.9\times10^{-4}$ mol per mol of silver halide, for a large-sized emulsion, and $1.1\times10^{-4}$ mol per mol of silver halide, for a small- sized emulsion)

To the red-sensitive emulsion layer was added the following compound in an amount of $2.6\times10^{-3}$ mol per mol of silver halide:

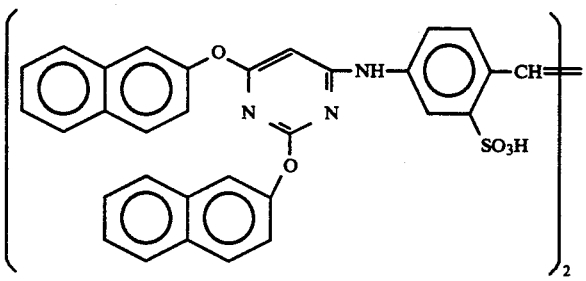

Further, 1-(5-methylureidophenyl)-5-mercaptotetrazole was added to the blue-sensitive emulsion layer, the green-sensitive emulsion layer and the red-sensitive emulsion layer in amounts of $8.5\times10^{-5}$ mol, $7.7\times10^{-4}$ mol and $2.5\times10^{-4}$ mol per mol of silver halide, respectively.

Furthermore, 4-hydroxy-6-methyl-1,3,3a,7-tetrazinedene was added to the blue-sensitive emulsion layer and the green-sensitive emulsion layer in amounts of $1\times10^{-4}$ mol and $2\times10^{-4}$ mol per mol of silver halide, respectively.

The following dyes were added to each emulsion layer for prevention of irradiation:

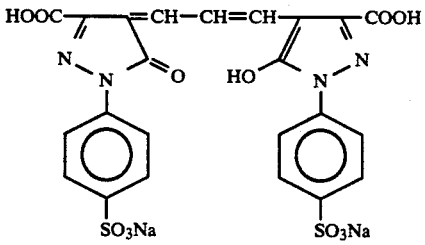

and

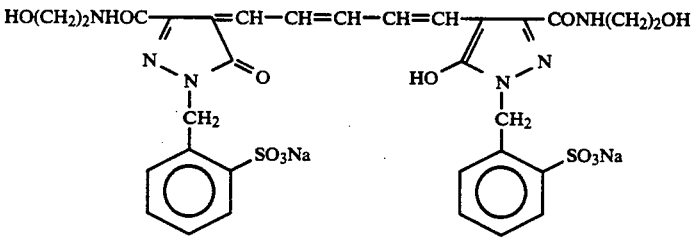

Layer Constitution

The composition of each layer is hereinafter shown. Numerals indicate coated weights ($g/m^2$). For the silver halide emulsions, numerals indicate coated weights converted to silver.

| | |
|---|---|
| Support | |
| Paper laminated with polyethylene [polyethylene on the side of the first layer containing a white pigment ($TiO_2$) and a bluing dye (ultramarine)] | |
| First Layer (Blue-Sensitive Layer) | |
| Silver Chlorobromide Emulsion Described Above | 0.27 |
| Gelatin | 0.74 |
| Yellow Coupler (ExY) | 0.67 |
| Color Image Stabilizer (Cpd-1) | 0.19 |
| Solvent (Solv-1) | 0.35 |
| Color Image Stabilizer (Cpd-7) | 0.06 |
| Second Layer (Color Mixing Preventing Layer) | |
| Gelatin | 0.75 |
| Color Mixing Inhibitor (Cpd-5) | 0.08 |
| Solvent (Solv-1) | 0.16 |
| Solvent (Solv-4) | 0.08 |
| Third Layer (Green-Sensitive Layer) | |
| Silver Chlorobromide Emulsion (cubic, a 1:3 mixture (Ag mol ratio) of an emulsion 0.55 μm in mean grain size and an emulsion 0.39 μm in mean grain size, coefficients | 0.12 |

-continued

| | |
|---|---|
| of variation in grain size distribution for the respective emulsions being 0.10 and 0.08, each emulsion containing 0.8 mol % of AgBr localized on the surfaces of grains) | |
| Gelatin | 0.66 |
| Magenta Coupler (ExM) | 0.26 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Light Absorbing Layer) | |
| Gelatin | 0.63 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-Sensitive Layer) | |
| Silver Chlorobromide Emulsion (cubic, a 1:4 mixture (Ag mol ratio) of an emulsion 0.58 μm in mean grain size and an emulsion 0.45 μm in mean grain size, coefficients of variation in grain size distribution for the respective emulsions being 0.09 and 0.11, each emulsion containing 0.6 mol % of AgBr localized on a part of the surfaces of grains) | 0.20 |
| Gelatin | 1.00 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer (Ultraviolet Light Absorbing Layer) | |
| Gelatin | 0.48 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer) | |
| Gelatin | 1.26 |
| Acrylic Modified Copolymer of Polyvinyl Alcohol (degree of modification: 17%) | 0.17 |
| Liquid Paraffin | 0.03 |

(ExY) Yellow Coupler:
A 1:1 mixture (mol ratio) of

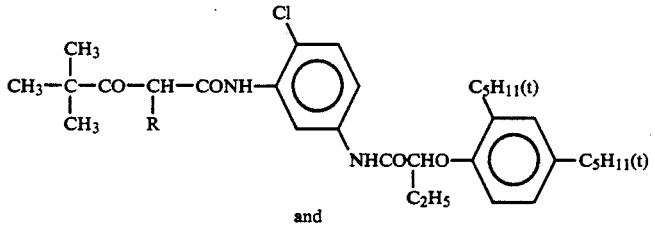

and

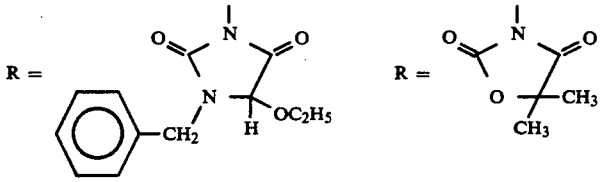

(ExM) Magenta Coupler:
A 1:1 mixture (mol ratio) of

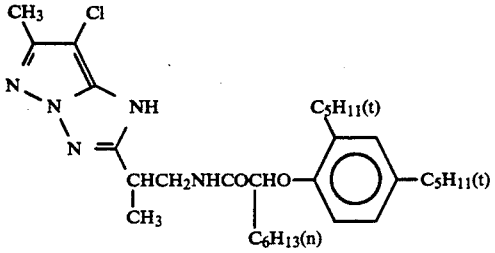

-continued
and
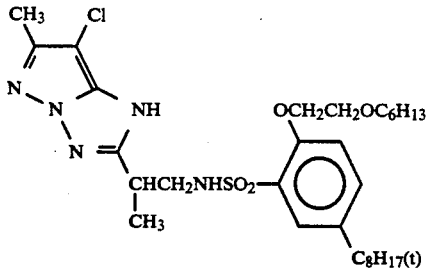
(ExC) Cyan Coupler:
A 2:4:4 mixture by weight of
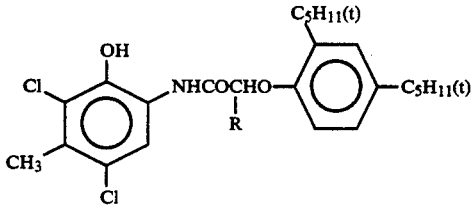
wherein R = $C_2H_5$ and $C_4H_9$,
and
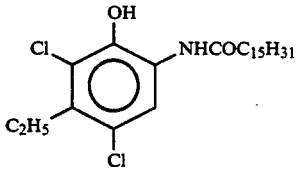
(Cpd-1) Color Image Stabilizer:
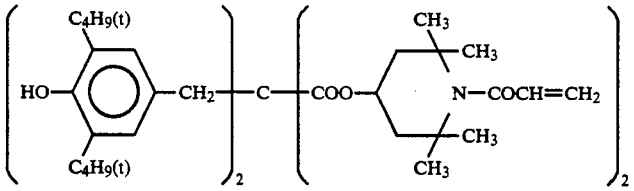
(Cpd-2) Color Image Stabilizer:
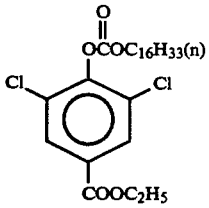
(Cpd-3) Color Image Stabilizer:
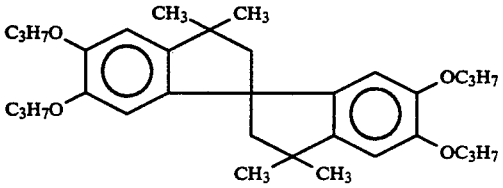
(Cpd-4) Color Image Stabilizer:

-continued
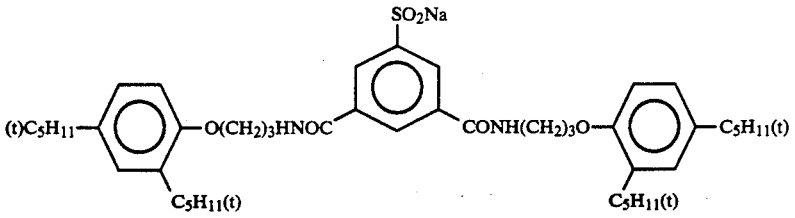
(Cpd-5) Color Mixing Inhibitor:
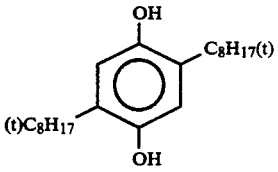
(Cpd-6) Color Image Stabilizer:
A 2:4:4 mixture (weight ratio) of
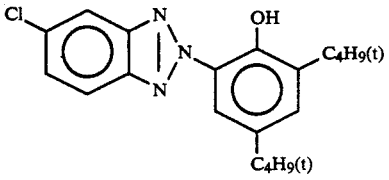
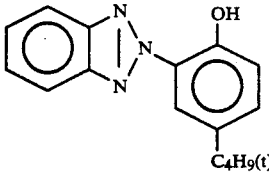
and 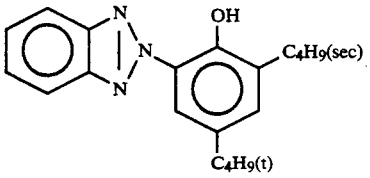
(Cpd-7) Color Image Stabilizer:
$$\left(CH_2-\underset{\underset{CONHC_4H_9(t)}{|}}{CH}\right)_n$$
(molecular weight: 60,000)
(Cpd-8) Color Image Stabilizer:
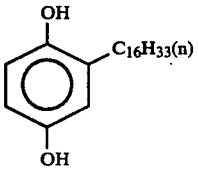
(Cpd-9) Color Image Stabilizer:

-continued
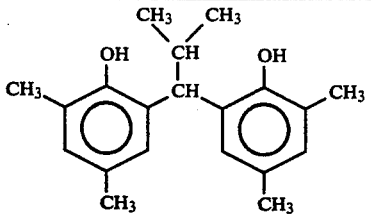
(UV-1) Ultraviolet Light Absorber:
A 4:2:4 mixture (weight ratio) of
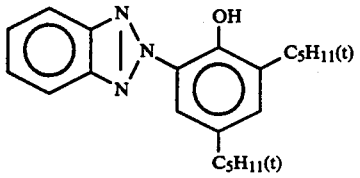
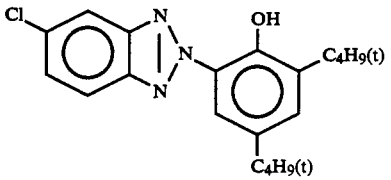
and 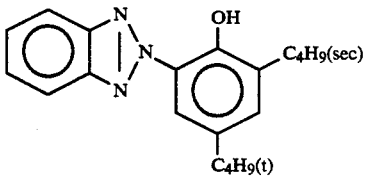
(Solv-1) Solvent:
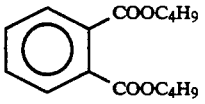
(Solv-2) Solvent:
A 2:1 mixture (volume ratio) of
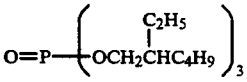
and
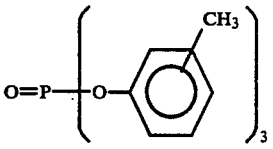
(Solv-4) Solvent:
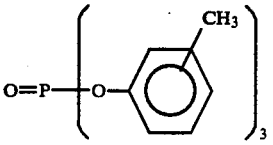
(Solv-5) Solvent:

-continued $COOC_8H_{17}$
|
$(CH_2)_8$
|
$COOC_8H_{17}$ (Solv-6) Solvent:

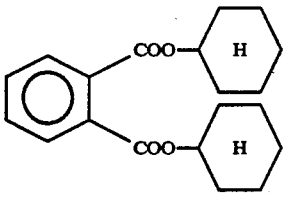

Thus, sample 101 was prepared.

This sample was subjected to radiation exposure through a three color separating filter for sensitometry by using a sensitometer (Fuji Photo Film Co., Ltd., FWH type, color temperature of light source: 3200° K.). The exposure at this time was adjusted so as to amount to 250 CMS when the exposure time was 0.1 second.

As to the sample to which the exposure was completed, continuous processing (running test) was carried out according to the following processing stages using a paper processor until the replenishment rate of the processing solutions reached two times the tank capacity of color development.

| Processing Stage | Temperature (°C.) | Time (sec) | Replenisher* (ml) | Tank Capacity (liter) |
|---|---|---|---|---|
| Color Development | 40 | 15 | 60 | 5 |
| Bleaching-Fixing | 40 | 15 | 60 | 5 |
| Rinsing (1) | 40 | 15 | — | 5 |
| Rinsing (2) | 40 | 15 | — | 5 |
| Rinsing (3) | 40 | 20 | 60 | 5 |
| Drying | 70–80 | | | |

*Replenishment rate: ml/m$^2$ of light-sensitive material

The composition of each processing solution was as follows.

| | Tank Solution | Replenisher |
|---|---|---|
| Color Developing Solution | | |
| Water | 800 ml | 800 ml |
| Ethylenediamine-N,N,N',N'-tetramethylenephosphonic Acid | 1.5 g | 2.0 |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(3-hydroxypropyl)-3-methyl-4-aminoaniline Diparatoluenesulfonate | 6.8 g | 9.5 g |
| N,N-Bis(carboxymethyl)hydrazine | 5.5 g | 7.0 g |
| Fluorescent Brightener (WHITEX 4B, Sumitomo Chemical Co., Ltd. | 1.0 g | 2.0 g |
| Water to make | 1000 ml | 1000 ml |
| pH (25° C.) | 10.05 | 10.45 |
| Bleaching-Fixing Solution | | |
| (tank solution and replenisher being the same) | | |
| Water | | 400 ml |
| Ammonium Thiosulfate (70 g/l) | | 100 ml |
| Sodium Sulfite | | 17 g |

-continued

| | |
|---|---|
| Ethylenediaminetetraacetic Acid Fe(III) Ammonium | 55 g |
| Disodium Ethylenediaminetetraacetate | 5 g |
| Ammonium Bromide | 40 g |
| Water to make | 1000 ml |
| pH (25° C.) | 6.0 |
| Rinsing Solution | |
| (tank solution and replenisher being the same) | |
| Ion-Exchanged Water (the content of each of calcium and magensium being not more than 3 ppm.) | |

After color development, the color developed density of yellow, magenta and cyan was measured with a densitometer to obtain a so-called characteristic curve.

Further, treated photographic materials on initiation and termination of continuous treatment were kept at 70° C. at 70% RH for 14 days, and the increments in blue color density on the minimum density portions by the elapse of time were evaluated as stains.

In addition, samples 102 to 105, 10A and 10B were prepared in the same manner as with sample 101, except gelatin GEL-1 used in preparing the emulsions and coating solutions for sample 101 was substituted for gelatins shown in Table 1.

TABLE 1

| Sample No. | Kind of Gelatin Used in Preparing Emulsion and Coating Solution |
|---|---|
| 101 | GEL-1 |
| 102 | GEL-2 |
| 103 | GEL-4 |
| 104 | GEL-5 |
| 10A | GEL-3 |
| 105 | GEL-1 (50% by weight)<br>GEL-3 (50% by weight) |
| 10B | GEL-1 (40% by weight)<br>GEL-3 (60% by weight) |

The isoelectric points of the gelatins used in this example are shown together in Table 2.

TABLE 2

| Kind of Gelatin | Isoelectric Point |
|---|---|
| GEL-1 | 9.0 |
| GEL-2 | 6.5 |
| GEL-4 | 5.5 |
| GEL-5 | 5.4 |
| GEL-3 | 5.0 |

For samples 101 to 105, 10A and 10B, images were sufficiently formed by development for 15 seconds, which revealed that rapid processing, one of the objects of the present invention, can be attained.

Further, the amount of staining is shown in Table 3.

TABLE 3

| Sample No. | On Initiation of Continuous Processing | On Termination of Continuous Processing |
|---|---|---|
| 101 | 0.12 | 0.17 |
| 102 | 0.13 | 0.19 |
| 103 | 0.14 | 0.18 |
| 104 | 0.13 | 0.20 |
| 105 | 0.14 | 0.22 |
| 10A (Comparative Example) | 0.15 | 0.34 |
| 10B (Comparative Example) | 0.14 | 0.26 |

It is known from the results that samples 101 to 105 according to the present invention are superior to samples 10A and 10B (comparative examples) particularly in terms of the amount of stain on the prints of treated samples after the continuous processing.

EXAMPLE 2

Using sample 101 obtained in Example 1, samples 201 to 209 were prepared in the same manner as with Example 1, except the processing conditions were changed as shown in Table 4.

TABLE 4

| Sample No. | Change in Condition | |
|---|---|---|
| 201 | Rinsing temperature 35° C. | |
| 202 | Organic phosphonic acid (47) in rinsing solution | 15 mmols/l |
| 203 | Organic phosphonic acid (47) in rinsing solution | 75 mmols/l |
| 204 | Organic phosphonic acid (47) in rinsing solution | 145 mmols/l |
| 205 | Organic phosphonic acid (47) in rinsing solution | 300 mmols/l |
| 206 | Organic phosphonic acid (38) in rinsing solution | 75 mmols/l |
| 207 | Organic phosphonic acid (2) in rinsing solution | 75 mmols/l |
| 208 | Organic phosphonic acid (66) in rinsing solution | 75 mmols/l |
| 209 | Rinsing temperature 30° C. | |

For samples 201 to 209, images were sufficiently formed by development for 15 seconds as with Example 1.

The amount of staining is shown in Table 5.

TABLE 5

| Sample No. | On Initiation of Continuous Processing | On Termination of Continuous Processing |
|---|---|---|
| 201 | 0.13 | 0.17 |
| 202 | 0.12 | 0.14 |
| 203 | 0.11 | 0.13 |
| 204 | 0.11 | 0.12 |
| 205 | 0.09 | 0.10 |
| 206 | 0.12 | 0.14 |
| 207 | 0.13 | 0.16 |
| 208 | 0.12 | 0.16 |
| 209 | 0.14 | 0.22 |

The results reveal that samples 202 to 208 of this Example are more improved than sample 101 of the present invention. Moreover, the results of samples 101, 201 and 209 reveal that further improvement is achieved by elevating the rinsing temperature.

According to the present invention, very rapid processing and continuous processing are possible, and color images of high quality are obtained. Further, the obtained color images do not exhibit an increased staining even under high temperature and humidity, and show excellent shelf lift. In particular, eve in the replenishment rate is reduced to not more than 150 ml per $m^2$ of photographic material in the washing stage, the excellent images that do not exhibit increased staining and fading of the image are obtained.

EXAMPLE 3

Samples 301 and 302 were prepared in the same manner as of sample 101 in the Example 1, except that a silver bromide was localizedly added in an amount shown in Table 6 over the grain surface in a silver chlorobromide emulsion layer of the first, third and fifth layers.

As a comparison, Sample 30A was similarly prepared.

TABLE 6

| Sample No. | AgBr content (mol %) | | |
|---|---|---|---|
| | 1st layer | 3rd layer | 5th layer |
| 301 | 4 | 5 | 6 |
| 302 | 3 | 3 | 3 |
| 30A (Comparative Example) | 12 | 13 | 12 |

Each sample was processed in the same manner as of Example 1. For samples 301, 302 and 30A, image were sufficiently formed by development for 19, 17 and 35 seconds respectively, comparing with 15 seconds in sample 101.

The high silver chloride content according to the present invention clearly shows remarkable advantages, in particular, when the silver chloride content is 98 mol% or more, as in the sample 101, the advantages are more remarkable.

EXAMPLE 4

Samples were prepared in the same manner as of the sample 101 except that a silver chlorobromide emulsion A-1, in which the same amount of a silver bromide was uniformly dispersed according to the following process, was used in place of the emulsion of sample 101.

Preparation of the Silver Halide Emulsion 4-1

To 800 ml of distilled water, 25 g of lime treated gelatin was added, and dissolved by heating to 40° C., followed by adjusting pH to 3.8 with sulfuric acid. Further, 1.7 g of sodium chloride and 0.01 g of N,N-dimethylethylenethiourea were dissolved into the aqueous solution to form an aqueous solution (I).

Separately, 125 g of silver nitrate was dissolved into 500 ml of distilled water to form an aqueous solution (II).

Further an aqueous solution (III) was prepared by dissolving 43 g of sodium chloride, 0.3 g of potassium bromide, 0.3 mg of potassium ferrocyanide and iridium hexachloride di-potassium salt into 500 ml of distilled water.

To the aqueous solution (I) heated to 55° C., the aqueous solutions (II) and (III) were simultaneously poured for 45 minutes and mixed. After removing an excess amount of salts from a dispersion of silver halide grains obtained by the above process, according to aggregating sedimentation, 50 g of lime treated gelatin was added and dispersed again. The dispersant, thus obtained, was sensitized by adding spectrally sensitized dye which was used in a blue sensitive emulsion layer of the Example 1, and sulfur-sensitized with N,N'-triethylthiourea.

The silver chlorobromide emulsion 4-1 thus obtained had 0.80 μm of average particle size and 0.09 of variation coefficient, and contained 99.8 mol% of silver chloride content was obtained.

A green-sensitive emulsion layer was prepared in the same manner as of the blue-sensitive layer above, except that in the silver halide emulsion 4-1, 1.2 g of potassium bromide and a sensitized dye used in the green-sensitive emulsion layer of Example 1 were used in place of 0.3 g of potassium bromide and blue-sensitive sensitized dye respectively.

Further, a red-sensitive emulsion layer was prepared in the same manner as of the blue sensitive layer above, except that in the silver halide emulsion 4-1, 0.9 g of potassium bromide and red-sensitive sensitized dye were used.

The sample prepared by using the above sensitized emulsion layers was processed and shows that an image is formed within a practically available ranges, a minimum density of the image is a little high and a sensitivity is slightly lowered.

While the invention has been described in detail and with reference to specific embodiments thereof, it will be apparent to one skilled in the art that various changes and modifications can be made therein without departing from the spirit and scope thereof.

What is claimed is:

1. A method for forming a color image comprising the step of:

developing a silver halide color photographic material for a color developing time of about 5 to 20 seconds and for a total processing time from color developing to drying of about 20 to 100 seconds, wherein said silver halide photographic material comprises (a) a support; and (b) at least two layers on at least one side of said support, each of said at least two layers containing (i) a silver halide emulsion containing 98 to 100 mol% silver chloride and at least 50% by weight of gelatin as a binder, said gelatin having an isoelectric point of at least 5.3, and (ii) a diffusion resistant oil-soluble couple that forms a dye by coupling with an oxidation product of an aromatic primary amine developing agent; and (c) said silver halide in said at least two layers differing in sensitivity wavelength range;

and wherein the total amount of said gelatin is 3.5 to 6.0 g/m$^2$; and wherein a color development replenishment rate is 60 to 150 ml/m$^2$.

2. The method for forming a color image as claimed in claim 1, further comprising the step of:

Washing said silver halide color photographic material (i) at a temperature of 35° C. to 42° C., (ii) using a countercurrent system of 2 to 5 washing baths, were the total time in each washing bath is about 45 seconds.

3. The method for forming a color image as claimed in claim 2, wherein the quantity of replenisher used in said washing step is less than 150 ml/m$^2$ of color photographic material.

4. The method for forming a color image as claimed in claim 2, wherein each of said washing baths contains an organic phosphonic acid, an organic phosphonate, or a combination thereof.

5. The method for forming a color image as claimed in claim 4, where said organic phosphonic acid, said organic phosphonate, or both said organic phosphonic acid and said organic phosphate is an alkylidenediphosphonic acid, a salt of an alkylidenediphosphonic acid, or a combination thereof.

6. The method for forming a color image as claimed in claim 4, wherein said organic phosphonic acid and organic phosphonate represent formulae (I) to (IV):

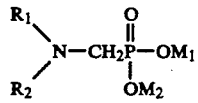
(I)

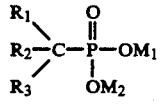
(II)

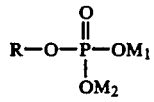
(III)

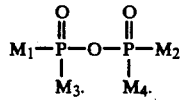
(IV)

wherein in generally formula (I), $M_1$ and $M_2$ each represent a hydrogen atom or a cation giving water solubility; $R_1$ and $R_2$ each represent an alkyl group having 1 to 4 carbon atoms, an aralkyl group, an alicyclic group, a heterocyclic group; and $R_1$ and $R_2$ may each be substituted for an hydroxyl group, a carboxyl group, an alkoxy group, a halogen atom,

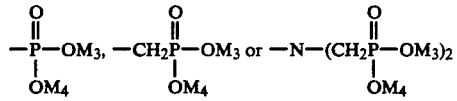

(wherein $M_3$ and $M_4$ have the same meanings as $M_1$ and $M_2$ described above;

in general formula (II), $M_1$ and $M_2$ have the same meanings as defined in general formula (I); $R_1$ represents a hydrogen atom, each of an alkyl group, an aralkyl group, an alicyclic group, and a heterocyclic group which are defined in general formula (I),

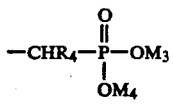

(wherein $R_4$ represents a hydrogen atom, a hydroxyl group, or an alkyl group), or

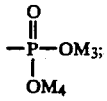

and $R_2$ and $R_3$ each represent a hydrogen atom, hydroxyl group, a carboxyl group, an alkyl group, a substituted alkyl group defined in general formula (I), or

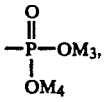

(wherein $M_3$ and $M_4$ have the same meanings as $M_1$ and $M_2$ described above);

in general formula (III), $M_1$ and $M_2$ have the same meanings as defined in general formula (I); R represents a hydrogen atom, each of an alkyl group, an alicyclic group and heterocyclic group which are defined in general formula (I)

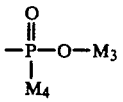

(wherein $M_3$ and $M_4$ have the same meanings as $M_1$ and $M_2$);

in general formula (IV), $M_1$, $M_2$, $M_3$, and $M_4$ each have the same meaning as $M_1$ and $M_2$ defined in general formula (I).

7. The method for forming a color image as claimed in claim 4, wherein said organic phosphonic acid and organic phosphonate are used in an amount of 2.9 m mol to 290 m mol per 1 l of washing or stabilizing bath.

8. The method for forming a color image as claimed in claim 1, wherein the silver halide has a constituent having none silver chloride part at a surface of grains in none-layered form.

9. The method for forming a color image as claimed in claim 1, wherein said color developing time is less than about 20 seconds.

10. The method for forming a color image as claimed in claim 9, wherein said color developing time is about 15 seconds or less.

* * * * *